United States Patent [19]

Scott et al.

[11] Patent Number: 5,009,387

[45] Date of Patent: Apr. 23, 1991

[54] OBJECT RETAINER FOR UPRIGHT CONCRETE CONSTRUCTION FORMS

[76] Inventors: Samuel C. Scott, 2519 Walnut St., Denver, Colo. 80209; William C. Scott, III, 4575 Joliet St., Denver, Colo. 80239

[21] Appl. No.: 306,168

[22] Filed: Feb. 6, 1989

[51] Int. Cl.[5] ..... E04G 9/10

[52] U.S. Cl. ..... 249/96; 249/15; 249/16; 249/112; 249/189; 264/35

[58] Field of Search ..... 249/13, 18, 15, 16, 249/91, 96, 112, 189, 219.1; 264/35, 261, 277; 425/123

[56] References Cited

U.S. PATENT DOCUMENTS

| | | | |
|---|---|---|---|
| 1,444,588 | 2/1923 | Copeland | 249/16 |
| 2,178,535 | 10/1939 | Willson | 249/15 |
| 2,465,871 | 3/1949 | Hardie et al. | 249/15 |
| 3,231,646 | 1/1966 | Conder et al. | 249/96 |
| 3,242,549 | 3/1966 | Boeglen | 249/96 |
| 3,602,476 | 8/1971 | Iragorri | 249/15 |
| 3,694,533 | 9/1972 | Kelsey | 264/277 |
| 3,868,801 | 3/1975 | Weiner | 264/35 |
| 4,095,771 | 6/1978 | van der Lely et al. | 249/112 |

FOREIGN PATENT DOCUMENTS

| | | | |
|---|---|---|---|
| 2127733 | 4/1984 | United Kingdom | 249/96 |

*Primary Examiner*—James C. Housel

*Attorney, Agent, or Firm*—James E. Pittenger

[57] ABSTRACT

A retainer device for holding objects within recesses provided on form liners which are attached to the inside surface of substantially upright concrete structural forms. The retainer device is attached to the form liner to hold the object against the liner so that after the concrete has been poured and set and the forms stripped, the objects will be exposed in the finished surface of the structure. Various retaining devices such as clips having enlarged heads and elongated stems with friction enhancing devices intended to be inserted or attached to the form liner so as to hold the clip in a secure relationship with respect to the objects. Another embodiment of the retainer device is a spring-biased clamp having a body encased within the form liner so that the clamp ends grip the sides of the object. In another embodiment, an elastic band is secured to the form liner ridge provided between recesses. The band is held in the ridge so that a dowel or pin can pass through the elastic loop and contact the objects to provide the holding force. A further embodiment is a flexible elastomeric cuff or receptacle having a thin outer membrane which has a thickness no more than one-half of the grout area between the bricks provided in the finished surface whereby the cuffs can be attached to the form to provide the retaining device and the liner receptacle for holding the brick in position during the pouring process.

15 Claims, 9 Drawing Sheets

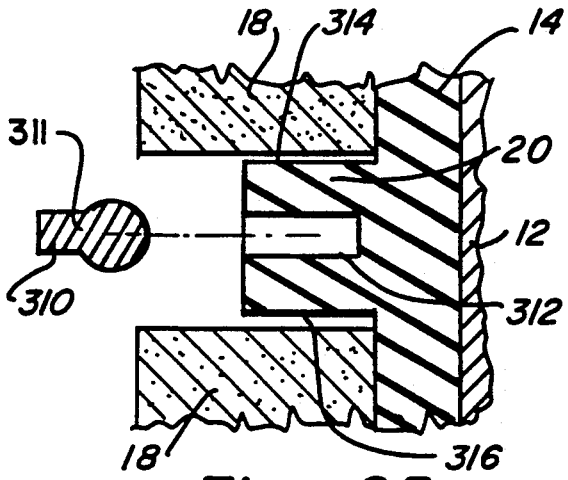
Fig_25
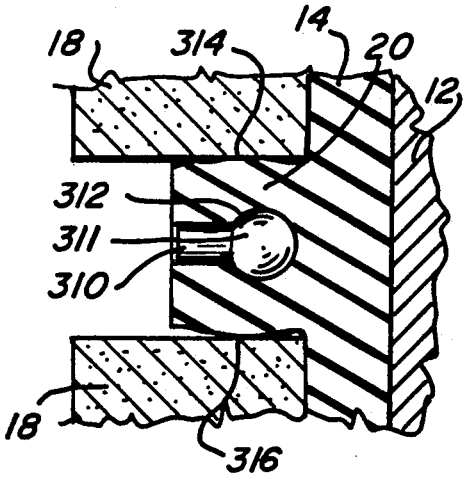
Fig_26
Fig_27
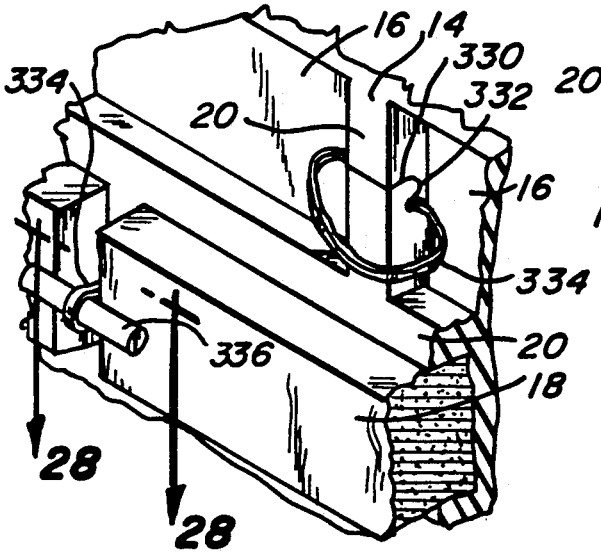
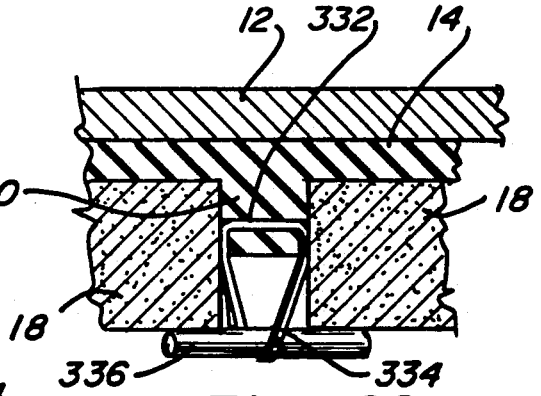
Fig_28
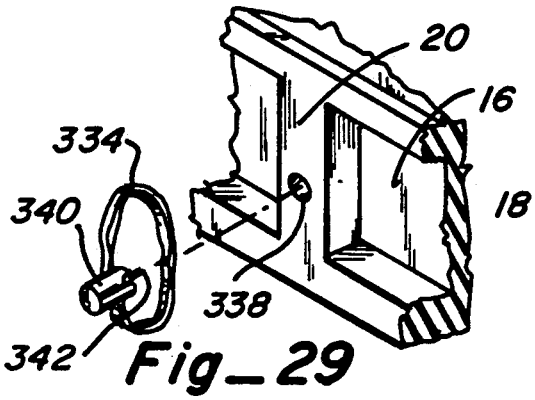
Fig_29
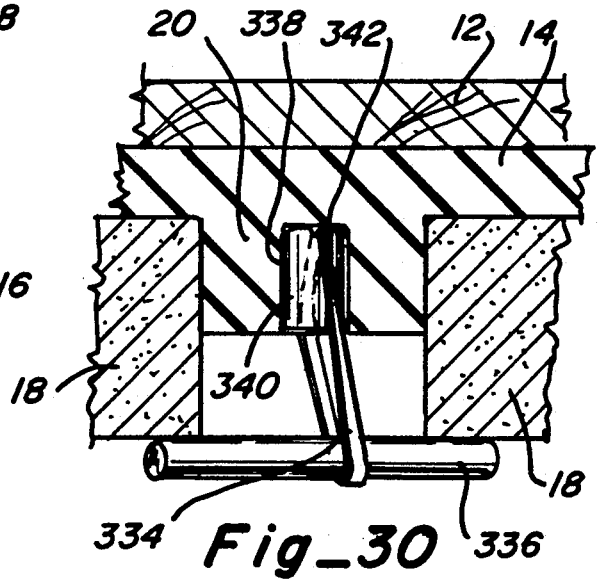
Fig_30

OBJECT RETAINER FOR UPRIGHT CONCRETE CONSTRUCTION FORMS

FIELD OF THE INVENTION

This invention is directed to a system for retaining surface objects within an upright concrete form. It is more specifically directed to retainer arrangements for holding bricks or tiles on the interior surface of a form for a vertical concrete structure.

BACKGROUND OF THE INVENTION

In the past, it has been a common practice to mount various types of resilient textured liners on the inside surface of a concrete form for the forming of decorative wall surfaces in the finished structure. Various surfacing texture is provided as a negative impression in the liner so that the finished concrete surface will have a pleasing aesthetic effect. One effect that is desirable in some concrete wall structures is the actual appearance of brick which makes the wall look like a true masonry structure.

The construction of a real brick wall is quite intricate as well as expensive. It takes a skilled brick layer to be able to lay brick aligned and in even courses to create a pleasing appearance and effect. The ability to combine these two types of construction, the laying of brick as well as the forming of a concrete wall, has been found to be in some ways, practical and yet, difficult to actually accomplish. There have been attempts to get around this problem by simulating the appearance of brick in total concrete construction. To do this, a concrete form liner is produced in a negative pattern so that when the wall is finished, it has the appearance of brick, but is actually totally formed from concrete. To carry the illusion even further, some people attempt to paint the surface of the concrete "brick" a brick color leaving the brick joint the natural concrete color so as to duplicate the look of real brick units in the wall.

In many cases, this type of simulated brick construction is unsatisfactory because it does not provide on architecturally satisfactory appearance of real brick or masonry construction. In order to better accomplish this task, there have been attempts to mount the real, full-size brick in small racks in staggered row relationship so that a construction panel having the appearance of a brick wall can be fabricated. With the bricks held in this position a concrete backing is then poured around the brick to surround and embed the bricks and hold them in proper position. In this way, a small brick-appearing concrete panel is produced which is extremely heavy and awkward to handle. These panels are then stacked to form a wall or other structure. One problem that is encountered in this method of construction is that the mortar which flows along the sides of the bricks does not always form an even composition or fill the voids and therefore, does not provide a true brick appearance. In addition, the handling of the brick panels is difficult and cumbersome which often results in broken bricks or separation in the joints between the panels.

To overcome the problems which presently exist, the applicant has found a new and novel way to combine the elastomeric form liner arrangement for forming a concrete wall or structure and include strategically placed and located real bricks or brick pavers in the outer finished surface.

A major problem which has occurred in the use of a liner in this type of construction is that when the form is positioned vertically, the pavers or actual bricks having varying dimensions are not held securely in the liner and in many cases fall from the liner to the bottom of the form leaving a void or spaced in the surface of the wall which necessitates the removal of a portion of the hardened concrete and the hand placement of a replacement brick to fill the void. Naturally, this repair and replacement takes considerable time and effort to accomplish and substantially increases the cost of construction. Another problem which exists during the pouring of the wall, is that the vibrators which are used during the pouring process also cause the bricks to become dislodged. This again creates the voids which are mentioned above and necessitates repairs.

It would be far better if it were possible to secure the bricks or brick pavers in the form liner so that none of them will be dislodged either prior to or during the pouring of the concrete. At the same time, it is necessary to be able to hold or retain the brick or brick pavers in the form liner so that the support structure will not show in the finished surface and help to form the mortar joint between the bricks while the form liner can be stripped from the forms and the retainer can be broken back at the surface of the concrete leaving no blemish or indication that the retainer existed. By the same token, it is necessary that the retainer for holding the brick in place during the forming process does not impede the removal of the form itself from the structure once the concrete has set.

INFORMATION DISCLOSURE STATEMENT

The following section is provided in order to comply with the applicant's acknowledged duty to inform the Patent Office of any pertinent information of which he is aware. The following information refers to the most pertinent patents of which the applicant has knowledge with respect to the subject matter of the present invention. Although other patents may be available which deal with the subject matter, they are believed to be less pertinent than the patents which are discussed herein.

The Bruckner patent (U.S. Pat. No. 1,147,704) discloses an imitation tile wall construction wherein strips having angular cross section are attached to the concrete side of the form. The strips are held in position by the use of finishing nails which are driven through the thickness of the form. In this way, the strip can be separated from the form by pulling the nail completely through the form. This patent shows no holding method other than the side to side effect of the strip.

The Willson patent (U.S. Pat. No. 2,178,535) discloses a method and apparatus for making brick-faced concrete walls. In this arrangement, a plurality of resilient strips are attached to the inside surface of the concrete form by means of a plurality of slots. The strips include a bulbous outer head with the strips positioned on the surface of the form at a precise distance which allows for the insertion of a brick or a thin tile fabricated from brick material. The bricks or tiles are held against the face of the concrete form by friction between the strips only. It is also shown that the strips can be held or attached to the concrete form by means of a nail driven through the strip and into the form. There is no face gasket action when the bricks are pressed on to the form face.

The Iragorri patent (U.S. Pat. No. 3,602,476) discloses a concrete form template for producing a brick-faced masonry panel. In this patent a resilient embossed sheet is attached to the surface of a concrete form panel. The surface of the sheet has a series of impressions with ridges between the impressions for retaining bricks, tiles or thin brick pavers within each of the depressions. The ridges between the receptacles apply friction against the outer edges of the brick pavers or tiles to hold them in place while the concrete is being poured and set. Friction is the only characteristic which is intended to hold the brick pavers or tiles in place during the pouring process. There is an intent to only use this brick form in a horizontal position which eliminates the need for providing any kind of a secured retainer for holding the bricks in position during the pouring process.

The Hardie, et al. patent (U.S. Pat. No. 2,465,871) discloses a building wall having a plurality of brick-like objects embedded in the surface. The brick objects are special from the standpoint that they have an elongated ridge formed on the back surface with the front surface positioned within recesses provided on the inside surface of the concrete form. A reinforcing mesh or grid is positioned on the back side of the brick ridges and the bricks are held in place by suitable clips attached to the mesh to hold the individual objects in place while the form is vertically positioned. The present invention utilizes only common brick products or objects and does not require specially shaped or designed bricks or objects.

The Dorsett patent (U.S. Pat. No. 2,964,800) discloses a form liner for covering the inside surface of a concrete wall form. The form liner surface has a number of ridges or matrix which casts the impression of bricks in the surface of the finished concrete wall. There is no provision for using actual brick products.

The Carriker patent (U.S. Pat. No. 3,148,433) discloses a way of attaching decorations to the inside surface of a concrete wall form. In the arrangement disclosed in this patent, a saucer-like plate is held in position against the form by means of a threaded stud which has a flexible bifurcated end. The outside surfaces of the ends of the stud are raised so that the stud can be inserted through a hole provided in the concrete wall from which the ends of the studs expand outwardly to hold the stud in position with respect to the form. The stud, in turn, holds the decorative plate against the form so that a depression is cast in the concrete wall.

The Kelsey patent (U.S. Pat. No. 3,891,178) shows a horizontal form for precasting a concrete panel having brick or tile facing inserts. The tile or bricks are held in position against resilient gaskets placed on the bottom surface of the form by means of a vacuum. The vacuum holds the tiles or bricks in position while the concrete is poured into the mold for casting the panels.

The Condor, et al. patent (U.S. Pat. No. 3,231,646) shows a bracket or holder for casting bricks in the surface of a concrete wall. The holder has a number of L-shaped hooks which extend through the surface of the concrete form with the hook holding a brick in proper position on the inside surface during the pouring of the concrete. There is no teaching of providing a gasket type liner to form the joint between the bricks.

The Stoeberl patent (U.S. Pat. No. 3,889,918) shows a process for opposed molded plastic shells. A strip of material is positioned between the two halves of the shell and is held in position by an expanded plastic foam filling. The strip is removed at the edge of the outer shell producing a slot extending inward into the shell. A mold or cap having a serrated or fluted stud is inserted into the slot to seal the opening.

The Cohen patent (U.S. Pat. No. 4,527,768) shows a concrete form self-securing tie rod having a dowel-like extension slidably mounted on the rod. The dowel-like portion of the element has teeth that lockingly engages an aperture formed in the concrete form.

The Dorris patent (U.S. Pat. No. 3,982,363) shows an insert body which is embedded in a concrete wall during construction. The insert body has a prong smaller than the rest of the body which is attached by a frangible neck. The prong has external ridges for holding the insert in an aperture formed in the concrete wall form. After the concrete has set, the prong is automatically broken off or broken back when the form is separated from the concrete structure.

The Holmboe patent (U.S. Pat. No. 4,054,258) shows a break-back form tie having a truncated conical seal mounted on the tie. The seal is arranged to have the outer end inserted into an aperture formed in the form for accessing the form tie. A break-back portion is formed at the end of the truncated conical seal portion so that once the concrete has set and the form is removed, the excess outer portion of the tie can be broken back at the surface of concrete.

SUMMARY OF THE INVENTION

The use of form liners in the construction of concrete walls and structures is a common occurrence at the present time. The liners are usually formed from resilient, rubber-like elastomer materials which are fabricated in sheets usually having a 4'×8' or 4'×10' size. These sheets are then fastened by suitable adhesives to the inside surfaces of similarly sized concrete structure forms. The outer surface of the form liner has a negative embossment or impression which leaves the opposite pattern or appearance in the surface of the concrete.

Up to now, many form liners have been made so that a wood-like appearance, mosaic design or textured surface is provided in the surface of the concrete structure. In addition, there has been an attempt to form a number of staggered recesses in the surface of the form liner so as to simulate an appearance of a finished brick wall. The imitation bricks are then painted a suitable brick color to further enhance the impression of the brick construction.

Another way of doing this is to provide a plurality of cavities or recesses in the surface of the form liner which are sized to fit the outline of the face of a brick paver. Brick pavers are understood to be a block formed from brick material which is approximately half the depth of an actual brick or a very thin member having approximately a one-half inch to a one and a half inch depth. Since the outline of the face of the brick is intended to be consistent and standard, the recess is sized within tolerances to accept and closely fit with friction the outer edges of the face of the brick. Two problems exist when this is done. First, the dimensions of the brick are not always uniform and thus, may vary a considerable amount such as approximately ⅛th to 3/16ths inch. Since the recesses in the form liner must be uniform, the bricks or brick pavers cannot always be pushed easily into the liner recess or they fit too loose in the liner recess to form a seal around the outer edge which allows the concrete to flow around the sides of the brick and possibly onto the face causing an unsatisfactory appearance. The recesses formed in the liner are naturally positioned in rows with the individual bricks staggered to provide the desired brick wall appearance. The sides of the retaining recess form the mortar joint.

These construction forms and form liners are designed for poured in place concrete. Poured in place concrete, while still in the liquid state (before the concrete actually hydrates to hardness) exerts liquid head pressure up to 8 psi against the form face. The exact pressures for various concrete mix designs are published in well known reference materials. It is sufficient to say that the liquid pressure is exerted not only on the face of the form, but on the form liner and the thin brick or tile objects as well. The smallest crack or opening allows concrete matrix to force its way behind the objects. If the crack or opening is of sufficient size the force of the liquid begins to work behind the objects trying to force the objects out of the liner recesses. Thus, the present invention is intended to overcome this pressure tendency.

As stated above, the form liner is usually made from resilient or flexible elastomeric materials which have some flexure and which can adapt to the various finished dimensions of the brick. However, when an attempt has been made to use this liner with the inclusion of the bricks or brick pavers in a vertical wall construction, the finished results leave a lot to be desired. In many cases, the bricks fall out and are not suitably retained in the liner with any degree of assurance which creates voids and necessitates the repairs which have been discussed in the background portion of this application.

In a form liner configuration which has the plurality of recesses sized to fit and hold the thin bricks or brick pavers, a positive ridge is formed between each of the recesses and this ridge has a height within the range of approximately ¼" to ½". The width of the ridge is determined by the spacing that is desired between the bricks in the finished wall the depth forms the mortar joint.

In the present invention, a mechanical retainer is provided which is inserted or attached to the elastomeric ridge which physically holds the bricks or brick pavers in proper position within and against the individual recesses. In some cases, the retainer is positioned at the corners of two adjacent bricks and the side of a third brick. In this way, one retainer can be used to secure a portion of two or three individual bricks. In other configurations, the retainer is positioned in the side ridge between two bricks and holds only those two surfaces. It is also possible that the retainer is positioned with respect to only one recess and retains only one individual brick associated with the corresponding recess.

The retainers according to the present invention can have many and varied configurations. One arrangement is the provision of various types of clips having either rigid or resilient heads. The head for the individual clip can be formed in the shape of a round or oblong disk or can be spider-like and have a number of outward extending appendages or arms. As will be appreciated if the head is formed from resilient material, greater latitude is provided in the dimensioning of the clips to accommodate various dimensional tolerances which exist in the brick manufacture.

The clip head is attached either permanently or through friction contact with an elongated cylindrical stud, stem or pin which can be inserted into an aperture or hole provided in the form liner ridge. The aperture or hole can be formed or molded in the ridge during the manufacturing of the form liner or can be made by drilling the material from the liner. In most cases, it is anticipated that the hole will be formed during the molding process of the liner itself. The end of the stud can have a number of different configurations such as a bulbous end, a plurality of circular rings or ridges formed on the end portion which increases the frictional retention of the stud in the liner ridge or any other arrangement which will allow the stud to be retained securely in the ridge and yet, allow it to be removed if and when this is necessary. The shank of the stud can be nicked or indented around its outer perimeter so as provide a fracture location or "break-back" in the area adjacent to the outer surface of the liner ridge. In this way, after the liner has been removed from the concrete, the exposed portion of the stud can be broken off at the weakened location to eliminate any appearance of the stud in the finished surface. This "break-back" configuration is highly desirable to reduce the time necessary to strip the forms and form liner as well as to remove the exposed portion of the studs.

It is also to be understood that the cross-sectional configuration of the clip stud is designed to be circular. It can also be any other configuration desired, such as square, rectangular, or polygonal. The only consideration which is necessary is that the stud must be of suitable diameter to provide the necessary strength and yet, be capable of being fractured or removed when desired. In addition, the materials used to make the stud and for that matter, the head, can be selected from any group of materials such as elastomers, plastics or metals which will provide the desired strength, friction and sufficient rigidity to hold the objects in place. It should also be noted that while the term "bricks" or "brick pavers" is used throughout this application, it should be also realized that many other objects can be retained in a form liner such as tiles, rocks or any other materials which can be utilized for architecturally decorating the outer and inner surface of a finished concrete structure.

Other retainers which can be provided form a different type of clip such as those having a sheet metal disk formed as the head. If desired, the disk can be perforated to allow the concrete or mortar to flow through and around the disk to prevent voids. A central aperture can be provided in the disk and a nail or other fastener can be inserted so that the end can be strategically positioned and driven into the form liner and possibly, but not necessarily the form. This is especially desirable where the form itself is plywood or a pliable sheet material which will accept and retain a nail or screw. Again, a "break-back" area can be provided on the shaft of the nail at the area adjacent to the surface of the form ridge to allow the protruding end of the nail or fastener to be broken off or removed from the finished concrete surface.

Another retainer which can be utilized to provide the same effect is to form a rectangular box having an open top with the thickness of the sides of the box being one-half of the space between bricks positioned in the wall. The box is usually fabricated from a resilient elastomeric material and forms a cuff around the face of the brick. The width of the box or cuff is approximately the same as the height of the preformed ridge which is molded in the form liners and forms the mortar joint in the finished wall. In this arrangement, the cuffs are attached usually to a plywood concrete form by the use of nails, usually finishing nails, driven through the sides of the cuff and directly into the plywood sheet. The cuffs are positioned the same as the recesses formed in the concrete liner to retain and hold the bricks or brick pavers in proper position during the pouring of the concrete wall. No accumulated tolerance error is noticed since each brick and cuff are a unit to themselves. A brick is inserted into each of the cuffs and is retained by a tight fit which produces sufficient friction to hold the brick in position. The fact that the individual cuff is usually formed from a resilient material provides additional retention especially during the vibrating process and absorbs the vibration to further eliminate the possibility of the brick becoming dislodged.

Another retainer which has been found suitable is to drill a hole through the form and form liner and insert a threaded bolt through the hole with a nut and washer at the opposite end holding a metal or resilient clip to retain the edges of the bricks in position. For removing the form, the threaded bolt is removed from the outside of the form before the form is stripped from the face of the wall. The removal of the bolt leaves a small hole in the finished structure which can be filled with a suitable grout or cement-like material.

A still further embodiment of the invention is to provide a lateral slot or cut in the ridge formed between two bricks or brick pavers. The end of the cut having a hook or "J" end configuration whereby an elastic band of sufficient size can be inserted into the cut ridge so that a dowel or peg can be inserted through the opposite ends of the elastic band and positioned on the outer surface of the bricks or pavers to retain them in position within the individual recess. Instead of a slot or cut being provided, it is also possible to insert a plug into a hole provided in the ridge to hold the elastic band in the liner. A still further arrangement of this embodiment would be to drill a hole through the sides of the ridge and insert the ends of the elastic band through the hole with the ends extending outwardly so that a peg or dowel can be inserted through the ends to retain the bricks.

It is also possible to mold outwardly extending tongues or projections in the ends or sides of the liner recesses to provide additional frictional holding capability to hold the thin bricks or brick pavers within the recess. This arrangement may necessitate the inclusion of an installation tool to allow the ridge to be held back while the brick is inserted.

A still further embodiment for the retainer can take the form of a U-shaped double-ended spring biased clamp which can have an elongated body actually embedded in the material of the liner and below the brick recess with the expandable ends of the retainer extending inwardly into the cavity formed in the recess. In other words, the retainer would have inwardly compressing ends which extend along opposite sides or ends of the brick recess so that when the brick is inserted, the mechanically retracted ends will retain the brick in proper position within the recess.

Although this last retainer can be formed from resilient materials, it can also be formed from a rigid tube which houses the ends of spring-biased clamps which form the side retainers for the brick. In order to cut down on the overall size of the retainer, it is usually expected that the retainer will be positioned across the width of the recess rather than the length. In addition, it is also possible to install one or more of these retainers in each recess depending upon the size of the object being positioned and held within the recess.

As can be seen, the object of the present invention is to provide a new and improved retainer for securely holding objects in proper position in a concrete form liner. A number of embodiments have been discussed. The primary intent is to provide a suitable retainer that does not totally depend on friction which will securely hold the object in the form liner so that a pleasing appearance can be provided in the surface of the finished structure. It is desirable also to provide a retainer which can be easily removed or separated repeatedly from the finished surface so that a minimum of additional time and labor is necessary to prepare the surface of the wall to provide the desired final appearance.

BRIEF DESCRIPTION OF THE DRAWINGS

FIGS. 25–26 show a cross-section of the form liner ridge having a hole formed in the ridge and a plug inserted in the ridge so as to expand and hold the brick pavers;

FIG. 27 is a partial perspective view of a retainer according to the present invention having an elastic band attached to the liner ridge and using a dowel with the elastic band to hold a pair of bricks in the liner;

FIG. 28 is a partial cross-sectional view taken along lines 28—28 of FIG. 27;

FIG. 29 is a perspective view showing an elastic band held in the liner ridge by means of a plug;

FIG. 30 is a cross-sectional view showing the elastic band secured in the liner ridge and retaining a pair of brick pavers by use of a plug;

DETAILED DESCRIPTION OF THE DRAWINGS

Figure 1:
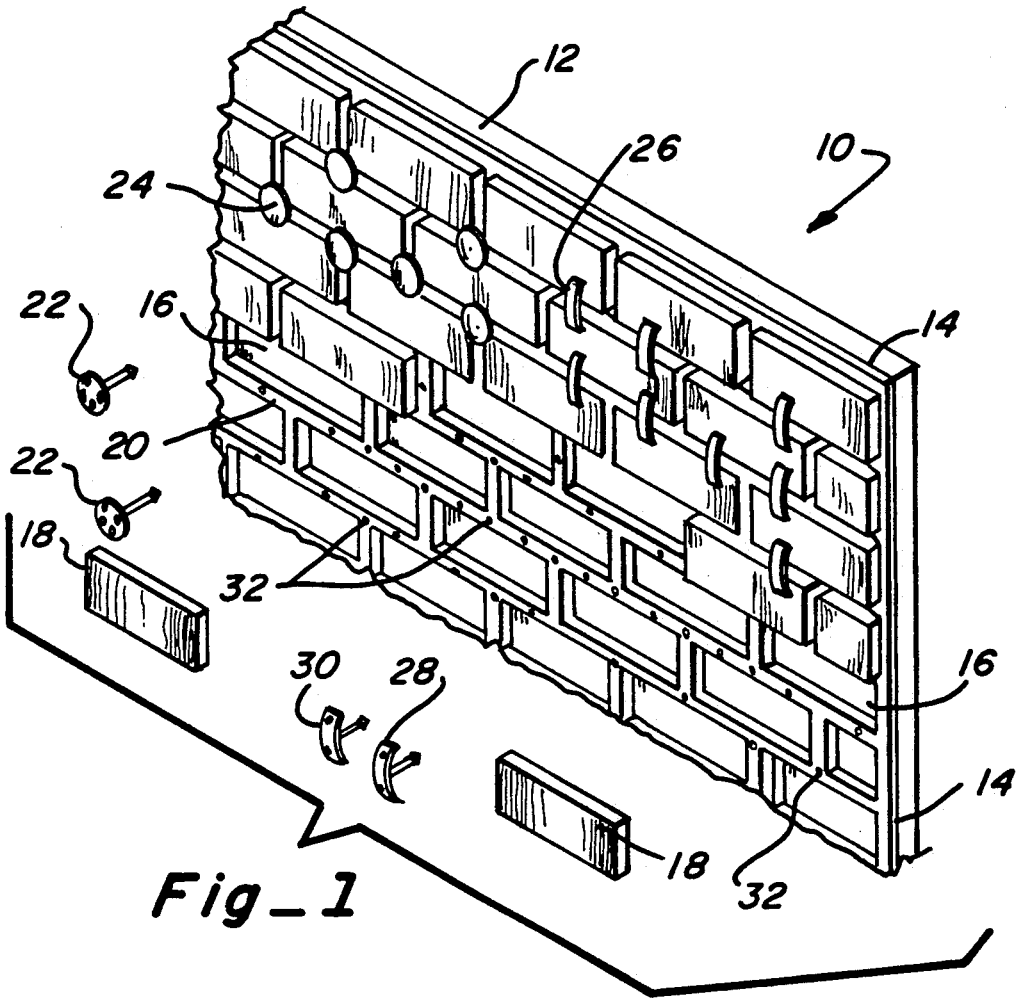
FIG. 1 is a perspective view of a concrete form and form liner having recesses for positioning and securing brick pavers and retainers according to the present invention positioned in the ridges for holding the pavers in secure position in the liner.

Turning now more specifically to the drawings, FIG. 1 shows a partially assembled concrete wall form 10 having a backing or reinforcing form 12 which can be made from plywood, synthetic resins or possibly sheet metal. A flexible form liner 14 is adhered to the inside surface of the form 12. Individual recesses or pockets 16 are molded or formed in the outer surface of the form liner 14. These recesses 16 are sized to closely fit the face of a common brick 18.

Throughout this application where reference is made to a brick it is to be understood that the brick could be a full sized brick or could be a split brick which is approximately one-half of the depth of the common brick. As an alternative, it is also possible that a brick paver which has the same face size, but is thinner than a common brick is also to be included. Also, it is possible that different types of objects can be retained in the form liner 14 such as tiles, stone or other objects which can be used for decorative purposes. As a result, the recesses 16, and in turn, the thickness of the form liner 14 can be varied or adjusted as necessary depending upon the type of object which is to be included. For the sake of illustration and this description, reference will be made to a brick paver or split brick which has the dimensions of the face of a common brick, but is only approximately one half of the depth or thickness. The brick paver is ideally suited for use in providing a brick face on a formed and poured concrete wall.

The recesses 16 are precisely arranged in staggered rows in the surface of the form liner 14 to resemble bricks in a masonry brick wall. As a result, a ridge 20 is formed between each of the recesses which resembles the normal grout line between brick. The form liner 14 is usually formed from a resilient flexible material such as an elastomer, rubber or plastic compound which is resilient, yet has sufficient rigidity to actually grip or support the brick paver 18.

Figure 3:
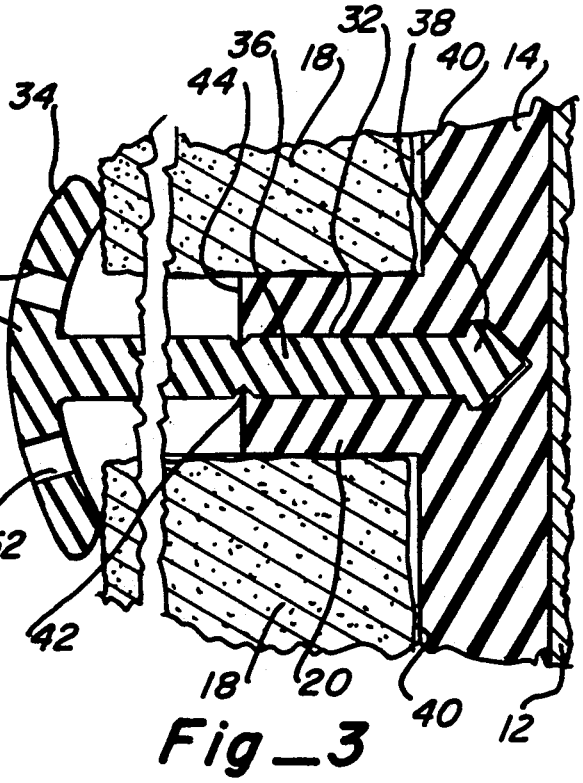
FIG. 3 is a partial cross-sectional view showing a retainer embedded in the form liner and holding the edges of two brick pavers in position.

The recesses 16 and the ridges 20 form a negative impression or pattern in the outer face of the form liner 14. The ridges 20 fill the area around each side of the brick paver 18 to a desired depth A as shown in FIG. 3 which forms the grout recess or pointed area between the individual bricks. This provides an appearance similar to an actual masonry wall that has been hand-laid by masons.

In the past, the form 12 has been laid in a horizontal position with the face of the form liner 14 facing upward. The brick pavers have been inserted in the recesses and the concrete is poured over the form. A much bigger problem is encountered when the concrete form is arranged in the usual vertical or upright position and is provided in large sized panels for commercial construction purposes.

The present invention is primarily directed to the upright form positioning and the placement of the individual brick pavers 18 into the recesses prior to the pouring of the vertical wall or structure. Various types of retainers such as clips 22, 24, 26, 28 or 30 are utilized to hold the brick pavers in position in their individual recesses. In the illustration, a retainer clip 30 is shown which has a relatively large head which will span the width of the ridge 20 and contact the back or outside surface of the brick pavers 18. The clip 30 includes a relatively large head 34 and stem or pin 36. The head 34 has a diameter which is large enough to at least contact two bricks and possibly three with the pin 36 being long enough to extend from the head and be buried approximately half of its length in the liner hole 32. An enlarged or bulbous end 38 having various shapes can be formed on the end of the pin so as to more securely retain the clip 30 within the hole 32 and securely retain the brick pavers 18. Any shape can be provided for the bulbous end 38 such as a round or pointed configuration. At the same time, the hole 32 can be enlarged at its deepest end or point which will correspond with the shape of the end of the pin 36 so as to provide a lip or shoulder for retaining the bulbous end 38.

As part of this construction, an absorbent paper or foam material 40 which will absorb water can be cut to closely fit the dimension of the bottom of the recess 16 and can be positioned in the individual recesses prior to the insertion of the brick pavers 18. This material is provided to absorb any water from the concrete grout which may seep past the edges of the recess 20 and the brick 18. In this way, the water is drawn away from the grout preventing the concrete grout from chemically setting on the face of the brick which would make it much more difficult to clean and remove the grout from the face of the brick after the form has been removed. In addition, a notch or groove 42 can be provided around the circumference of the shank of the pin 36 at a point which coincides with the outer surface 44 of the liner ridge 20. This provides a weakened area or "break-back" area 42 so that the outer end of the pin 36 can be broken away and removed after the form has been pulled. In this way, there is no projection in the grout line extending outwardly between the brick pavers to distort or impair the outer appearance of the brick wall.

Figure 2:
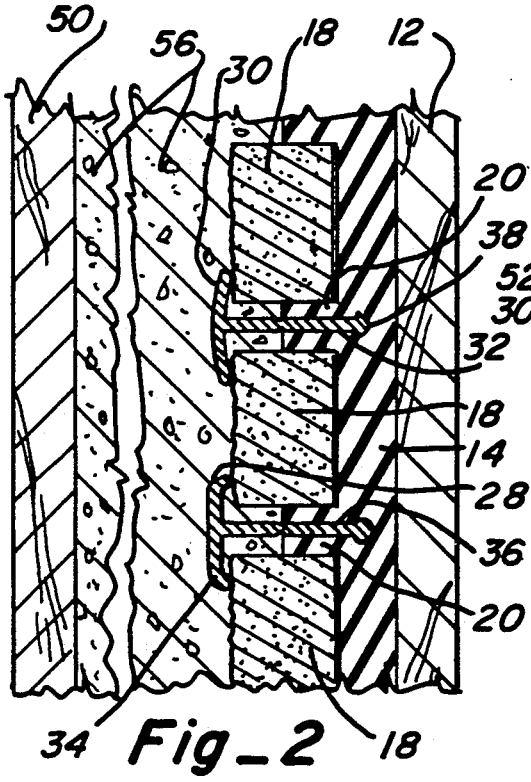
FIG. 2 is a partial cross-sectional view through a formed and poured concrete wall showing the brick pavers and retainers embedded in the concrete and form liner.

As shown in FIG. 2, when it is desired to form a wall structure, a form 12 with its attached form liner 14 is first raised into an upright, vertical position. As an alternative, it could be laid horizontally close to its final placement and raised into place prior to the actual pouring of the concrete. Brick pavers are positioned in each of the recesses 16 and the retaining clips 28, 30 are inserted so that their pins 36 are inserted into the holes 32. Sufficient force is used to insert these clips so that the friction of the resilient form liner 14 will grip the end of the pins 36 so as to hold the heads 30 with sufficient force to retain the bricks 18 firmly within the recesses 16. If desired, a slight convex curvature can be applied to the head 34 so that when the pins are inserted, they can be inserted with sufficient force to allow the heads 34 to flex outward so as to apply a constant additional holding force on the bricks. In addition, openings 52 can be provided in the heads 34 to allow concrete to pass through and around the heads so as prevent the presence of voids in the concrete and still form a mortar joint between the individual brick units.

In a wall having a single brick side, once the clips have been properly installed and the bricks are firmly held in position in the liner, a second plain form 50 is positioned on the opposite side and at a proper distance as determined by the thickness of the intended wall. After both of the forms have been properly positioned, the concrete 56 is introduced between the forms from the top so as to completely fill the cavity between the forms as well as the grout area between the bricks 18. One of the advantages of the retainers provided in the present invention is that they are resilient and flexible enough to be able to absorb the vibrations which are applied to the forms and the bricks by the concrete vibrators which are used to consolidate the wet concrete in the forms during the pouring process so as to fill all cavities and prevent voids. The vibrating process has proven to be quite detrimental to prior art devices that have been utilized to form this kind of construction. As a result, the present invention is a decided improvement over the prior art and allows the use of the vibrators without causing detrimental effects.

As in normal concrete construction, form ties can be positioned through the space established between the forms 12 and 50 to hold the forms in their proper position to make sure that the wall will have constant thickness. Where a tie passes through the form liner and recess 16, it is common practice to insert into the recess a rubber block which can be solid or hollow and sized the same as a brick paver 18. This block usually has a hole passing through it for the passage of the form tie (not shown) and permits the positioning of the form tie through the concrete wall during the pouring of the concrete. Once the concrete is set and the form is removed, the rubber block can be easily removed from the wall and replaced by a brick paver which can be glued or held in place by mortar in the cavity formed by the rubber block.

Up to now, we have been talking about clips that can be molded from plastic or any other types of resilient material. In addition, it is also possible to mold or shape these clips from metal, usually of a soft alloy type. The important thing with respect to the clips is that they be of a sufficient strength to retain the brick pavers in place and at the same time be resilient enough to bend or flex so as to apply a constant holding force on the object. It is also highly desirable that the pin or stem of the clip have sufficient strength so as to not fracture during installation or concrete place and yet break at the desired "break-back" point when subjected to a sudden blow or pull during clean-up.

While a circular head has been shown for clips 22, 24, clips having rectangular or strip type heads 26, 28, 30 can also be provided. Apertures, openings or cutouts 52 can be provided in the heads to allow the passage of the grout through and around the heads so that voids will not be encountered and also so that the clips will be firmly embedded in the concrete and permanently retained without moving. The clips which have been illustrated in FIGS. 1–3 are directed to only one embodiment of the invention while a number of embodiments actually exist.

Figure 4:
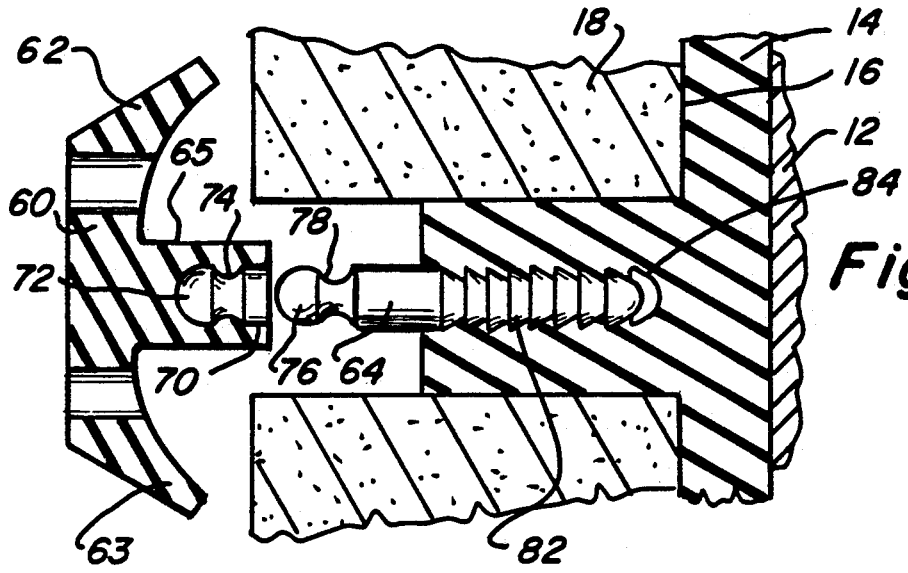
FIGS. 4–6 show a cross-sectional view of the assembly of the flexible brick retainers and the stripping of the form from the finished brick wall structure.
Figure 5:
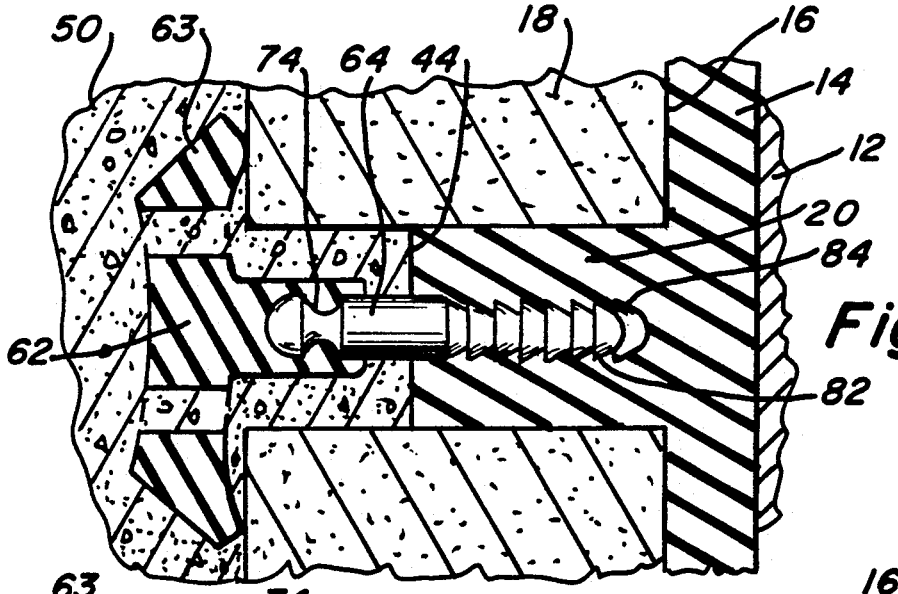
Figure 6:
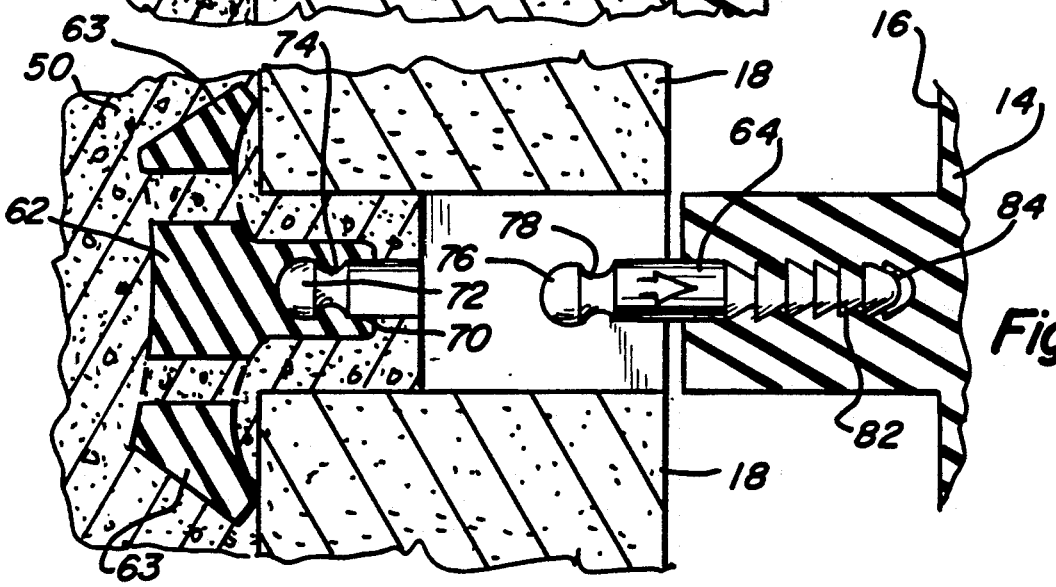

FIGS. 4–6 disclose another embodiment of the retainer which is part of this invention. FIG. 4 shows a clip 60 having a removable head section 62 and pin or stem portion 64. In this embodiment, the head 62 can be molded from resilient elastomeric material or plastics. Usually the head is formed in a generally rectangular configuration which will allow it to straddle and contact two bricks, or in a three or four-armed configuration with the arms equal angularly spaced so that the arms 63 will contact the outer surface of each of the adjacent bricks 18. The central core 65 of the head 62 has a molded blind hole 70 formed therein with the hole 70 having a rounded inner end 72 and a slightly curved inwardly extending circumferential ridge 74. The stem or pin 64 is a separate item and has a rounded end 76 and a circumferential curved notch 78 at one end. The opposite end of the pin 64 is serrated so as to provide a rough surface 82. As illustrated in these figures, it is also possible to provide a series of sharp-edged circumferential rings around the end of the pin 64 to increase the friction holding force. A hole 84 can be provided through the mid-portion of the ridge 20 as described above to accept and hold the end of the pin 64. If desired, the hole 84 can be molded or formed in the ridge 20 by either drilling or molding during the fabrication phase. Although it is not absolutely necessary that a mating surface be provided to coincide with the configuration of the end of the pin, it is desirable to provide a number of circumferential ridge to securely hold the end of the pin in the resilient ridge material. This arrangement provides much stronger retention which is required during the stripping of the forms.

FIG. 4 shows the insertion of the head 62 onto the pin 64 during the installation of the bricks 18. In this way, the central core 62 is pushed until it mates with the head of the pin and thus, is securely held in position. In this position, the predetermined length of the shank of the pin 64 and the center core 65 causes the arms 63 to flex outwardly to apply additional pressure against the back surface of the bricks 18.

FIG. 5 shows the concrete 50 poured around the head and stem of the clip 60 filling a grout line adjacent to the outer surface 44 of the ridge 20.

In FIG. 6 the form liner 14 and pin 64 have been stripped from the bricks and concrete structure with the shank of the pin 64 withdrawn from the center core 65 of the head 62. With this configuration, it is understood that the head 62 must be formed from a sufficiently resilient material so that the pin can be withdrawn from the hole 70 provided in the core 65. Once the pin 64 has been withdrawn, an opening or void remains in the grout where the pin had been positioned. If it is desired, these holes can be filled with grout or patching material.

Figure 7:
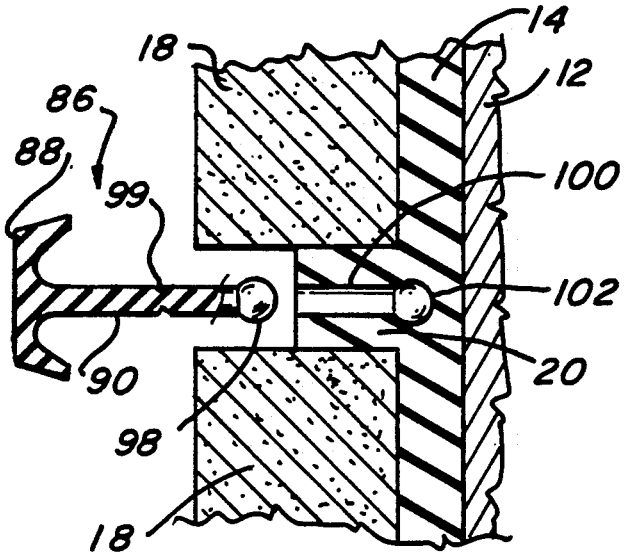
FIG. 7 shows a partial cross-sectional view of another embodiment of the retainer.
Figure 8:
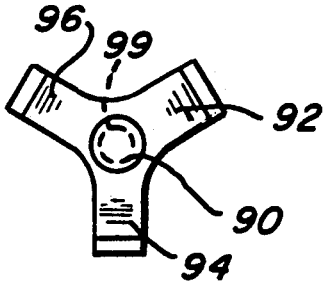
FIG. 8 shows a top plan view of the head of the retainer shown in FIG. 7.

FIG. 7 shows another embodiment of the retainer which has been previously described. In this embodiment, the retainer 86 includes head 88 and stem or pin 90. The head 88 is formed by extrusion or injection molding from relatively resilient or plastic material. As shown in FIG. 8, the retainer has three equally spaced arms 92, 94, 96 which have sufficient length to be able to bridge the gap between the brick pavers 18. When it is placed at the corner of a junction between three bricks, each arm is positioned to contact and secure a portion of its respective brick. The pin or stem 90 includes an enlarged or bulbous end 98 and a circumferential "break-back" notch or score line 99. The ridge 20 is formed with a receptacle aperture 100 having a bulbous or enlarged end 102 which essentially conforms to the size and shape of the pin 90. After the brick pavers 18 have been positioned in the liner 14, the end 98 of the retainer 86 is inserted into the hole 100 strategically located in the ridge 20 of the liner 14. The depth of the end 98 corresponds with the depth of the aperture 100 and is properly positioned so that the arms 92, 94, 96 properly contact the back of the brick pavers 18 and are bent or stressed to apply a moderate force to retain the brick pavers in position. Sufficient friction is created by the bulbous end 98 within the liner material 14 to properly secure the retainer 86 in position. The resiliency characteristic of the retainer 86 and of the material used to form the liner 14 is important in this embodiment since it helps to absorb the vibrations which are created by the vibrator used in pouring and positioning the concrete within the wall form.

Figure 9:
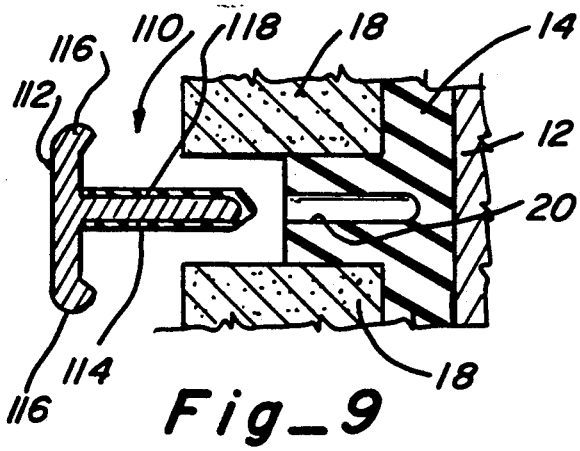
FIG. 9 shows a partial cross-sectional view of another embodiment of the retainer.

FIG. 9 shows another retainer 110 having a flat head 112 and integral smooth-sided pin 114. The head can have an inwardly extending lip 116 which can be positioned on the edge of the head 112 or can be a circumferential ridge on a round head. A coating 118 of latex rubber or other soft material can be used to coat the pin 114 over either part or all of its length. As an alternative, the coating 118 can be an elastic sleeve in which the pin 114 is inserted. An elongated aperture or hole 120 is formed in the ridge 20 of the liner 14 and sized to accept the pin or stem 114. The coating 118 provides an increased coefficient of friction between the liner material 14 and the pin 114 so as to provide a positive grip or hold on the pin 114 when it is inserted.

Figure 10:
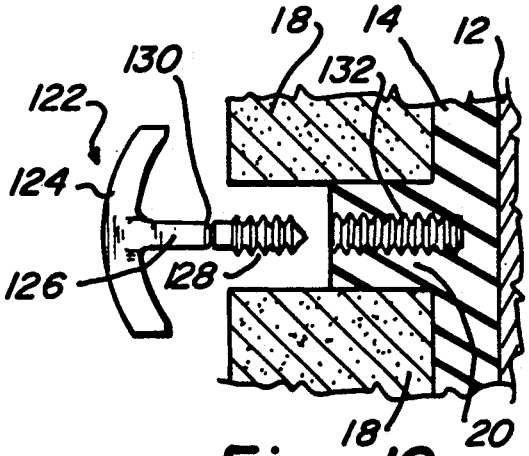
FIG. 10 shows another cross-sectional view of another embodiment of the retainer.

FIG. 10 shows a retainer 122 having an inwardly curved or disk-shaped head 124 and pin 126. The pin 126 has a serrated or multiple ridged surface 128 near its outer end. A "break-back" notch 130 is also provided on the shank of the pin 126. The mating hole 132 provided in the elastomeric ridge 20 can be either straight sided or have a serrated surface corresponding to the surface 128 on the pin 126. Again, the length of the hole 132 usually has a depth greater than necessary so that the pin 126 can be inserted as far as necessary to apply a desired stress to the head 124 and, in turn, provide a retaining force on the brick pavers 18. It is to be understood, however, in this type of retainer that the serrated surfaces 128 and the mating hole 132 in the liner 14 provide sufficient friction to hold the retainer 122 in proper position, but still will allow the liner 14 to be stripped from the serrated surface 128 on the pin 126 to allow the pin to remain intact when the form and liner is removed. In this way, the liner can be reused repeatedly without having to remove a portion of the pin from the liner before the next use. This is desirable even though the end of the pin extends beyond the grout line between the bricks once the liner has been pulled. Although this necessitates the breaking of the pin 126, it still provides a more desirable way of removing and reusing the liner and form.

Figure 11:
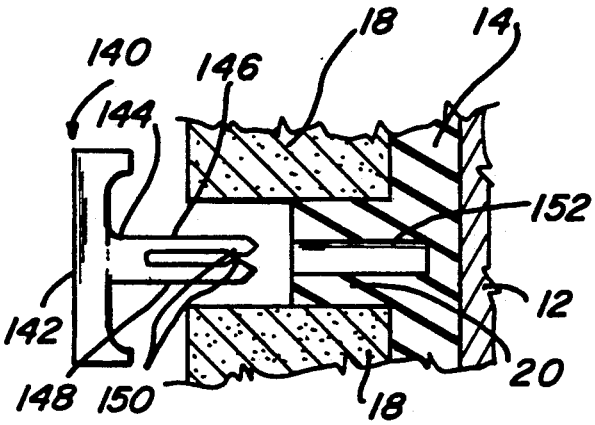
FIG. 11 shows a partial pictorial cross-sectional view of another embodiment of the retainer.

FIG. 11 shows another retainer 140 having a head 142 and stem or pin 144. The pin 144 is split or bifurcated into two extended legs 146, 148 which have inwardly extending detents 150 provided on their outer ends. An elongated relatively smooth-surfaced hole or aperture 152 is provided in the ridge 20 of the liner 14. Upon insertion of the retainer pin 144 the legs 146, 148 are squeezed together until the detents 150 contact each other so that the ends can be started in the hole 152, but yet, form an outward pressure to increase the frictional retaining force on the liner 14. Again, the retainer 140 is inserted into the hole 152 a sufficient distance so that the head 142 and its outer edges contact the brick pavers 18 providing the necessary retaining force.

Figure 12:
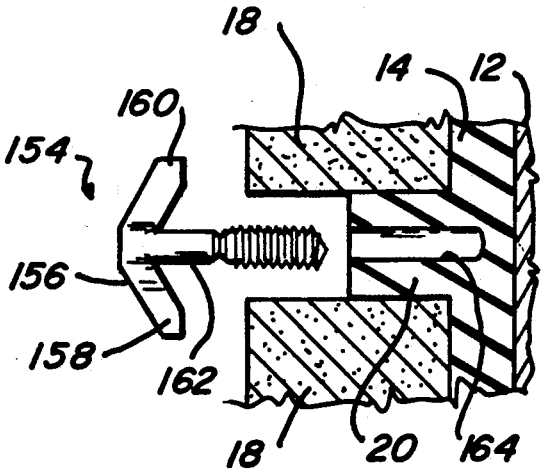
FIG. 12 shows a partial pictorial cross-sectional view of another embodiment.

FIG. 12 shows retainer 154 having a head 156 having inwardly angled arms 158, 160 which are intended to contact the brick pavers or objects. The pin 162 is formed similar to the arrangement shown in FIG. 10. The aperture 164 formed in the ridge 20, however, in this arrangement has smooth or straight sides with the serrations formed on the end of the pin 162 gripping the sides of the aperture 164 to provide the necessary friction for retention and allow repeated reuse of the liner.

Figure 13:
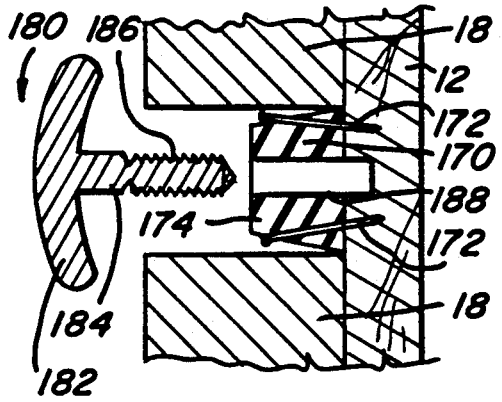
FIG. 13 shows a cross-sectional view of another embodiment of the retainer with the form ridge nailed to the plywood form.

FIG. 13 discloses another embodiment wherein the liner 14 is omitted. In this arrangement, strips of resilient material which can be the same material which was used for the form liner 14 are strategically positioned on a plywood or veneer sheet form 12 to provide the necessary recesses for the brick pavers 18. The strips 170 can have straight sides perpendicular to the surface of the form 12 or can have slightly tapered sides as shown in FIG. 13. The strips 170 are secured directly to the plywood form 12 by means of finishing nails 172 or any other suitable fastener which will secure the strips 170 to the side of the form. The nails 172 can penetrate through the sides and into the form or they can be driven through the outer face 174 of the strips 170. A retainer clip 180 having a curved head 182 and pin or stem 184 is provided. The end of the pin 184 can have a serrated or knurled surface 186, if desired. An elongated hole 188 is drilled or formed through the strip 170 and if additional length is required into the plywood form 12. Where the serrated end 186 of the pin 184 only penetrates the resilient material of the strips 170, the pin can be of relatively rigid material. If it is to pass into a hole formed in the plywood form 12, then it will have to be of a resilient material so that it can be compressed to enter into the rigid material of the form. An alternative to this would be to form the hole in the form at a larger diameter than the pin so that interference will not exist. Where the hole 188 penetrates through the strips 170 it can be of a slightly smaller diameter so that the serrated surface 186 expands or stretches the resilient material forming the strips 170 so as to expand the sides of the strip placing additional friction against the pin as well as the sides of the brick pavers 18.

Figure 14:
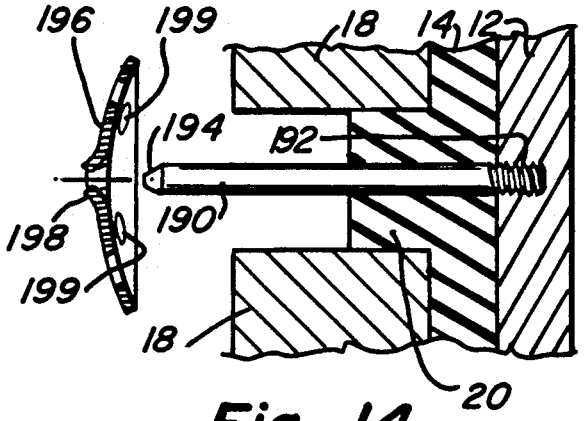
FIG. 14 shows a cross-sectional view of an embedded stud positioned through the form liner and a force fit disk head for positioning on a stud to hold the brick pavers in place.

FIG. 14 shows a slightly different approach from the retainers previously described. In this arrangement, an elongated pin or stud 190 having a threaded end 192 is threaded or screwed into the form material 12 and passes through a hole formed in the ridge 20 of the resilient liner 14. The pin 190 has a pointed outer end 194 and has sufficient length to extend past the back surfaces of the brick pavers 18. A concave disk 196 usually formed from plastic or formed sheet metal is arranged with a centrally positioned hole 198. The center hole is usually formed by punching the hole with a sharp instrument from the concave side of the disk 196. The edges of the hole 198 are then left bent in an outward position so that as the disk 196 is pushed over the pointed end 194 of the pin 190, it will move easily in a direction toward the back surface of the brick pavers 18 and be forced against these objects. However, the sharp edges of the hole 198 will grip the sides of the pin 190 and prevent it from moving backwards thus, holding the disk 196 tightly against the brick pavers 18. Additional openings or perforations 199 can be provided to allow the grout and concrete to pass through the disk to fill the void between the pavers. When the form 12 and liner 14 are stripped from the construction, the pin 190 is pulled out with the form 12 so as to leave the disk 196 embedded in the concrete. Naturally, the remaining hole is or can be patched.

Figure 15:
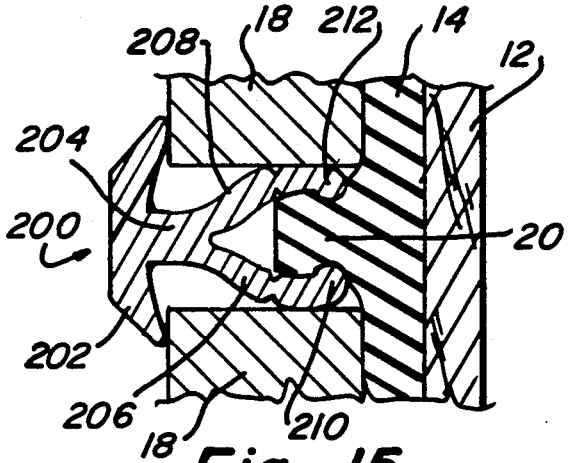
FIG. 15 is a cross-sectional view of a one-piece clip retainer having bifurcated ends for retaining the bricks in place.

FIG. 15 shows another embodiment, wherein a clip retainer 200 can be formed from a generally rigid material such as metal or plastic. The form liner is again a resilient material having a ridge 20 which generally positions and forms a space between the brick pavers 18. The clip 200 can have either an elongated head 202 or the head can have multiple extending arms or can be circular as desired. Usually the arms are curved inwardly and may have some flexure so as to provide additional holding force against the brick pavers 18. The stem 204 has two outwardly curved legs 206, 208. The legs 206, 208 end in inwardly curved ends 210, 212, respectively, which provide a gripping action. These legs can also be scored or notched to form a "break-back" location adjacent to the outer edge of the ridge 20.

In use, the clip 200 is inserted so that the legs 206, 208 are forced around the sides of the ridge 20 with the ends 210, 212 gripping against the sides. In this way, the legs 206, 208 are forced along the sides of the brick pavers 18 and cause the resilient ridge material to be compressed to provide the necessary holding force. At the same time, the head 202 contacts the back surfaces of the brick pavers 18 retaining these objects in proper position. After the concrete has been poured and set, the form 12 and liner 14 are pulled from the construction leaving the ends 210, 212 exposed. These ends, in turn, can be broken off at the "break-back" line to leave an open area between the bricks. As previously stated, the surface where the legs have been broken away can be patched or covered with a grout or other sealant material.

Figure 16:
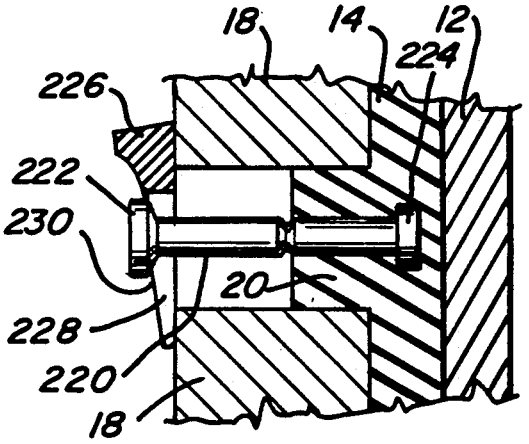
FIG. 16 is a cross-sectional view showing an embedded stud with a wedge retainer for holding the bricks in place.

FIG. 16 shows a different approach to the retainer arrangement in that an elongated retaining pin 220 is utilized to hold the brick pavers in position. In this arrangement, the pin 220 has enlarged flanged ends 222, and 224. The flanged end 224 is embedded in a suitable hole provided in the flexible ridge material 20. The opposite flanged end 222 and the exposed length of the pin 220 is arranged so that the flange 220 extends a predetermined distance beyond the outer surface of the brick pavers 18. A fork-like wedge 226 having sufficient length to bridge the gap between the brick pavers 18 includes a centrally positioned slot 228. The outer surface 230 of the wedge 226 is slightly tapered so as to fit a corresponding surface on the underside of the flanged end 222 of the pin 220. The wedge 226 is positioned so that the slot 228 engages the underside of the flanged end 222 and contacts the surface of the opposite brick paver. By gently tapping the wedge, the tapered surface slides under the end 222 causing slight additional force to be applied to the outer surface of the brick pavers 18. In this way, the friction between the wedge 226, the flanged end 222 and the brick pavers 18 holds the pavers 18 in proper position during the concrete pouring process.

Figure 17:
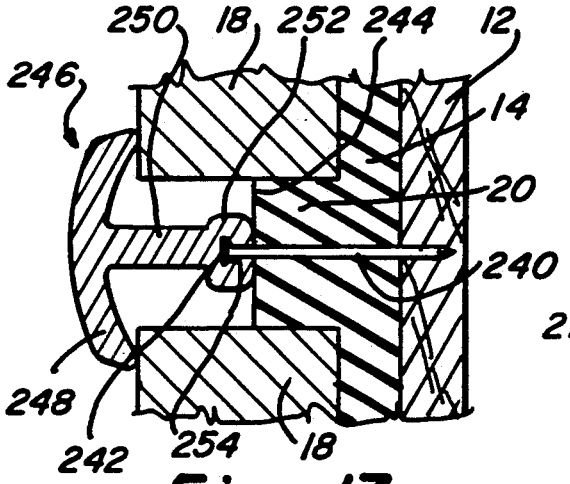
FIG. 17 is a cross-sectional view wherein the resilient retainer is positioned over the head of a nail embedded in the form.

FIG. 17 shows an arrangement where a nail 240 is driven through the ridge 20 of the liner 14 and into a plywood form 12. The head 242 of the nail 240 is positioned to extend beyond the outer surface 244 of the ridge 20. The head 242 has a sufficiently large head similar to a cross between the head of a common nail and finishing nail. A clip 246 having a curved head 248 and stem 250 includes an enlarged end 252. The enlarged end 252 includes a receptacle or aperture 254 which is provided to receive the head 242 of the nail 240. The clip 246 is formed from a relatively resilient material, but should be sufficiently rigid at least in the stem and head portion. The end 252 can be formed either from the same material or a more resilient material to allow the receptacle or aperture 254 to receive and grip the head 242 of the nail 240. After the concrete has set the form 12 and liner 14 along with the nail 240 are withdrawn. This leaves the aperture 254 in the clip end 252 which can be closed or sealed by grout or other sealant material.

Figure 18:
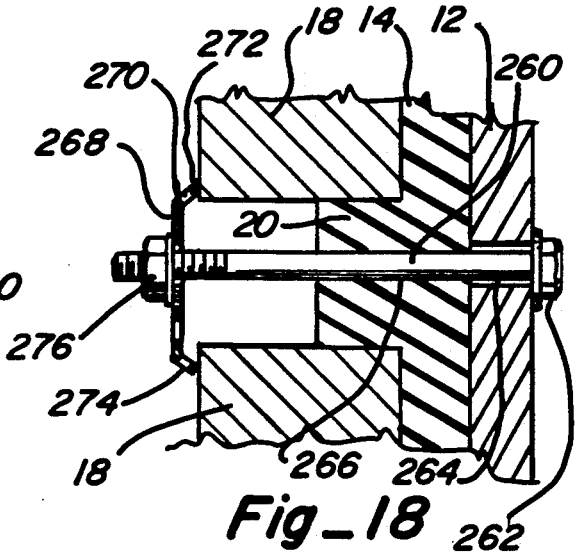
FIG. 18 is a cross-sectional view of a clip bolted in position through the form.

FIG. 18 shows a bolt arrangement which may be less desirable than some of the other embodiments described. In this arrangement, the common threaded bolt 260 is inserted through an enlarged hole 264 formed in the form material 12 and inserted through a smaller diameter opening 266 formed in the ridge 20 of the liner 14. The liner 14 will essentially hold the bolt in position with the threaded portion extending beyond the outer surface of the brick pavers 18. A clip or disk 268 having holes 270 and downwardly bent outer ends 272, 274 is positioned over the threaded end of the bolt 260 and is held in position by a threaded nut 276. Although in this embodiment, the bolt 260 generally has considerably greater strength than is necessary, the nut 276 is tightened only sufficiently to provide the necessary retaining force on the back surface the brick pavers 18 without distorting the liner 14. The threads of the bolt 260 can be coated with a gel or lubricant to prevent the concrete from adhering to the bolt and threads. After the concrete has set, it is necessary to back out the bolt 260 by turning the head 262 so as to withdraw the threaded end of the bolt through the nut 276. Naturally, the nut 276 and clip 268 remain in position within the set concrete. After the form 12 and liner 14 have been removed, the hole left by the bolt in the finished concrete can be patched or sealed.

Figure 19:
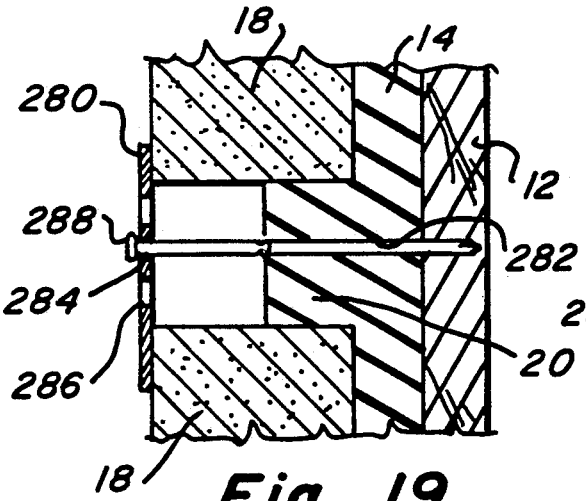
FIG. 19 is a partial cross-sectional view showing a disk-shaped clip held in position by a nail embedded in the form.
Figure 20:
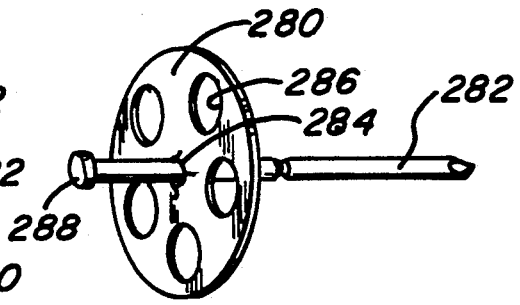
FIG. 20 is a perspective view of the clip arrangement shown in FIG. 19.

FIG. 19 is an embodiment which needs no additional or prior preparation. The brick pavers 18 are positioned on either side of the ridge 20 in the recesses formed in the liner 14. A retaining disk 280 is provided with a central aperture 284 which is sized to fit the body of a nail 282. The disk 280 has perforations 286 which allows the concrete to pass through to prevent voids. The shank of the nail 282 can be notched at the proper location to provide a "break-back" for the finished product. The nail is positioned through the central opening 284 in the disk 280 and is driven through the liner ridge 20 and into the plywood form backing 12. The head 288 rests against the outer surface of the disk 280 which in turn, rests against the outer surface of the brick pavers 18 holding the bricks in proper position. When the liner 14 and form 12 are pulled from the wall, the nail 282 remains protruding from the surface of the construction. At this point, it is necessary to break off the outer end of the nail at the "break-back" notch to eliminate this projection.

Figure 21:
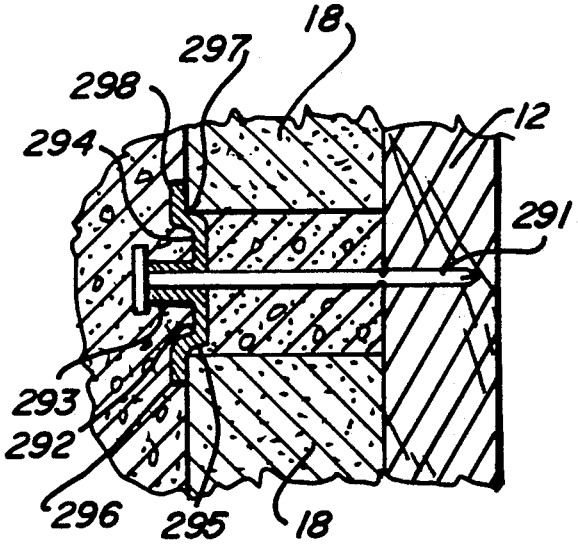
FIG. 21 is a cross-sectional view of a clip held in position with a nail and the concrete formed around the retainer and brick pavers.
Figure 22:
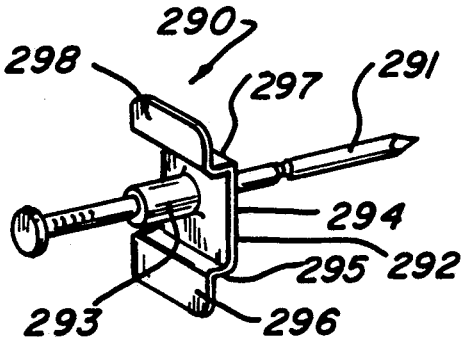
FIG. 22 is a perspective view of the retainer shown in FIG. 21.

The embodiment shown in FIGS. 21 and 22 is similar to the arrangement shown in FIG. 19. The difference being that the liner 14 is eliminated and the brick pavers 18 are held in position by the retaining clip 290. The clip 290 is usually formed so as to have a rectangular projected body 292 having a central portion 294 and outer flanged ends 296, 298. A perpendicular shoulder 295, 297 forms a transition between the body section 294 and the outer ends 296, 298, respectively. A cylindrical collar is formed on the outer surface of the central portion 294 so as to receive a common nail 291. The nail 291 has a "break-back" notch provided at the proper location so that when the retaining clip 290 is held in position between the brick pavers 18, the shoulders 295, 297 and ends 296, 298 rest on the edges of the adjacent bricks to properly hold the brick pavers in proper spaced position between each other and against the form 12. A filler strip similar to the ridge 20 of the liner 14 can be inserted between the bricks and adjacent to the inner surface of the form 12 to provide a recess in the grout around the individual brick pavers.

Figure 23:
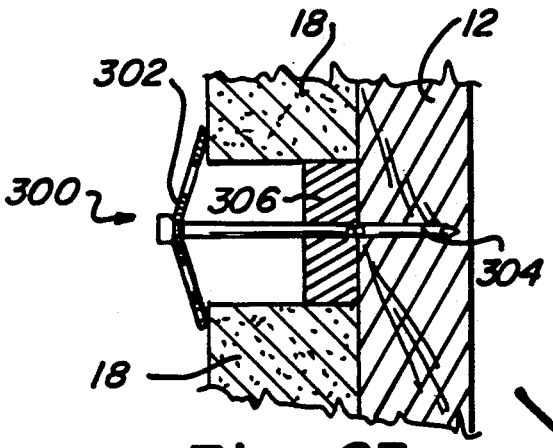
FIG. 23 is a cross-section of an inverted disk retainer held in position by a nail in the form.
Figure 24:
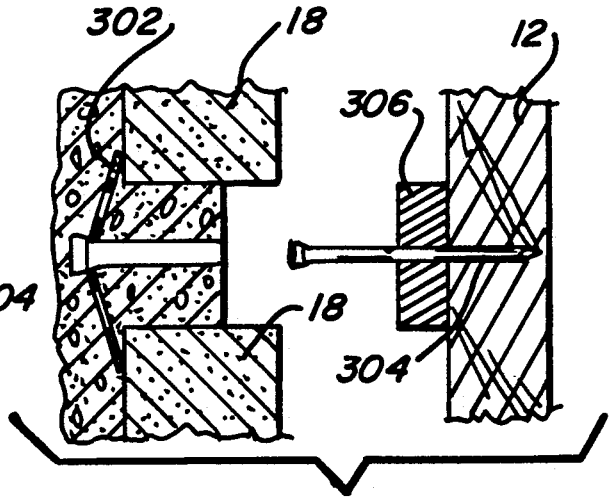
FIG. 24 is a cross-sectional view showing the retainer in FIG. 23 with the form stripped from the finished wall.

FIGS. 23 and 24 show another form of the arrangement just described. In this embodiment, the retainer 300 includes a concave disk 302 held in position by a suitable finishing type nail 304. A spacer strip 306 is positioned between the brick pavers 18 to properly space the pavers and provide a void in the finished grout line. After the form 12 and strip 306 is removed from the finished construction, it is possible that either the nail can be pulled through the central opening in the disk 302 so as to allow the nail to be completely withdrawn from the concrete or the head of the nail 304 can be left in the concrete and the end broken away at the "break-back" notch. Either way appears to be satisfactory for the intended results.

FIGS. 25 and 26 show another variation in which the ridge 20 of the liner 14 is sized to provide a slight additional clearance between the brick pavers 18. A small ridge or corner can be positioned at the base of the ridge 20 for properly positioning the bricks, if desired. Once the bricks have been placed in position, a plug 310 can be inserted into an aperture or hole 312 centrally positioned in the ridge 20. The plug 310 has a bulbous end 311 having a diameter which is approximately one and one-half times the diameter of the hole 312. Since the ridge 20 and liner material 14 are resilient, the insertion of the plug 310 causes the ridge 20 to expand outwardly so that the sides 314, 316 of the ridge 20 contact and grip the sides of the brick pavers 18. Depending upon the size of the enlarged end 311 of the plug 310, sufficient force can be applied to the sides of the brick pavers 18 to increase contact friction and thus, properly hold the brick pavers in position. The pulling of the form 12 and liner 14 can be easily accomplished because of the resilient nature of the ridge 20 which allows the liner merely to be pulled away from the brick pavers. This embodiment is particularly desirable since it leaves nothing embedded within the concrete nor leaves any openings or protrusions extending from the grout line between the bricks. If a slight clearance is provided along the sides of the ridge 20, it will allow the grout to pass down along the sides of the brick and leave a small flashing along the edges of the grout line giving a slightly curved appearance which adds realism to the finished wall.

Another and somewhat different retainer arrangement is shown in FIGS. 27–32. In this arrangement, the ridge 20 in the liner 14 existing between the vertical sides of the recesses 16 is cut or sliced 330 transversely across the ridge 320. The cut 330 penetrates approximately half of the height of the ridge 20 and then curves back on itself forming a hook configuration 332. An elastic or rubber band 334 is inserted with a portion of the loop positioned in the hook area of the cut 330. A dowel or pin 336 having sufficient length to bridge the gap between the brick pavers 18 is looped through the elastic band 334. The length of the elastic band 334 is designed so that the distance between the end of the slot 330 and the outer surface of the dowel or pin 336 will provide enough tension in the band 334 to apply the required amount of retaining force on the outer side of the brick pavers 18. When the form 12 and liner 14 are stripped from the construction after the concrete has set, the elastic bands 334 will either be pulled from the slot 330 in the ridge 20 or caused to break releasing the liner 14. With this arrangement, it is necessary to cut the exposed remaining portion of the elastic band from the grout line between the bricks. Another arrangement is to provide an aperture or hole 338 in the ridge 20 and secure the elastic band 334 in the ridge 20 by means of a plug 340 having sufficient diameter to create a force fit in the aperture 338 provided in the liner 14. The resiliency of the material forming the liner 14 allows the plug 340 to be substantially gripped or secured. A notch 342 can be provided on the inner end of the plug 340 to properly position and hold the elastic band 334. Again, the elastic band 334 is properly sized to apply the desired tension on the dowel or pin 336 after the plug 340 is inserted.

Figure 31:
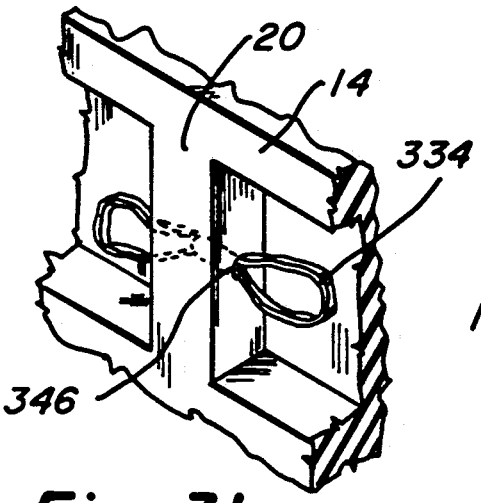
FIG. 31 is a partial perspective view showing an elastic band extending through the form ridge.
Figure 32:
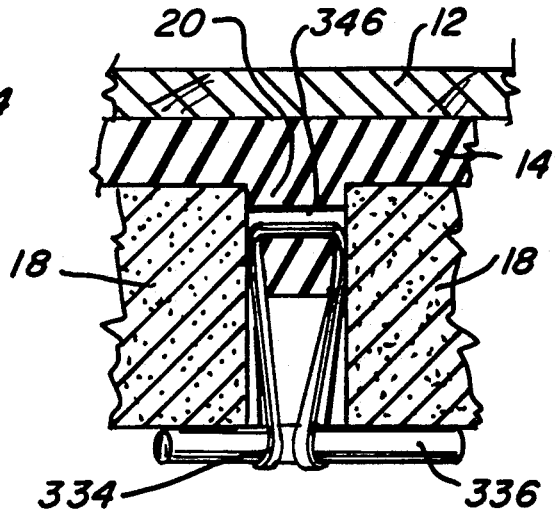
FIG. 32 is a partial cross-sectional view showing the elastic band of FIG. 31 retaining a pair of bricks by use of a dowel.

FIGS. 31 and 32 show another variation of the elastic band embodiment wherein a lateral hole is drilled or formed through the ridge 20 so as to receive the insertion of the elastic band 334. Once the band 334 has been inserted through the hole 346, the ends of the band are then pulled outwardly around the dowel or pin 336 to properly hold and position the brick pavers 18. Again, the elastic band 334 is sized so that in this doubled configuration, it will provide the necessary force on the dowel and bricks.

Figure 33:
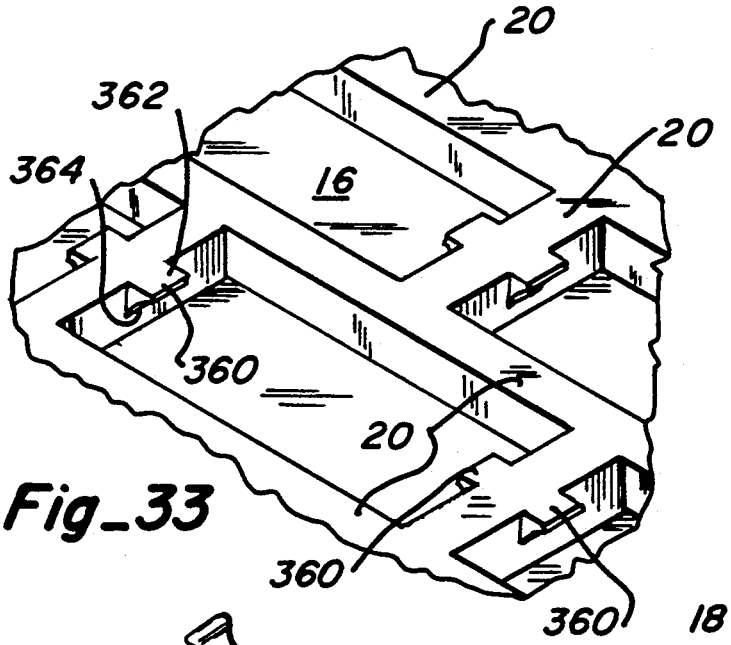
FIG. 33 is a partial cross-sectional view showing projections formed in the ends of the form liner recess.
Figure 35:
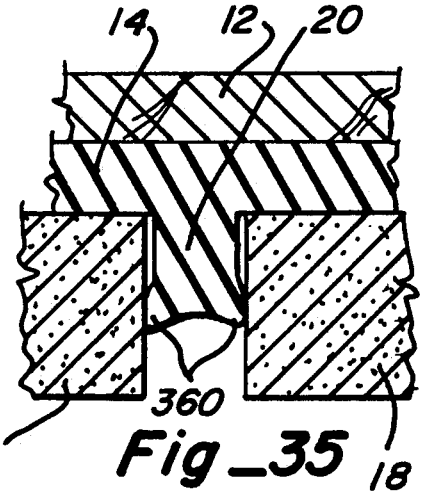
FIG. 35 is a partial cross-sectional view showing the positioning of a pair of bricks held in position in the form recesses.
Figure 34:
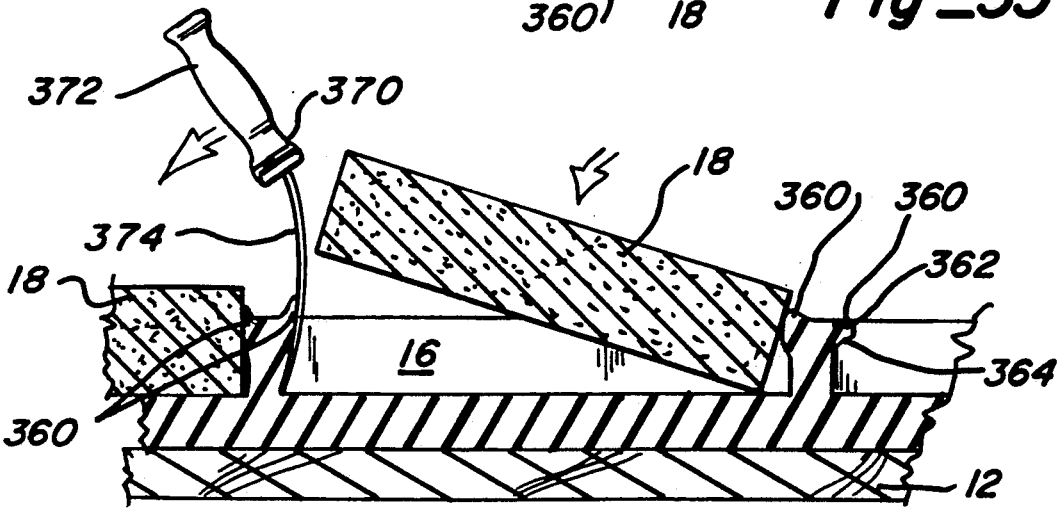
FIG. 34 is a pictorial cross-sectional view showing the installation of a brick in the recess of FIG. 33.

Another embodiment showing an entirely different retainer arrangement is shown in FIGS. 33–35. In this embodiment, the liner 14 includes the brick recesses 16 as well as the formed ridges 20. The ridges 20 are molded as one continuous piece and each of the short dimensions of the ridges 20 include a projection or ear 360. The projections 360 can be formed from the same resilient material as the liner 14 or can be a different material inserted and bonded to the liner. Each projection has an outwardly extending outer surface 362 and a backwardly tapered lower surface 364. Although it is possible to position the projections 360 to extend along the full length of the edges of the recesses 16, it is anticipated that only a short section approximately one-inch long will be necessary. The projections 360 are utilized to properly position and hold the brick pavers 18 in the recesses 16.

A flexible tool 370 having a handle 372 and a flexible thin blade 374 can be used for installing the bricks 18. The end of the flat blade 374 is inserted into the bottom of the recess 16 and the handle is moved outwardly as shown in FIG. 34 so as to bend the blade 374 and cause the projection 360 to be pulled backward or compressed. At the same time, the brick paver 18 is inserted so that one end is pushed against the opposite projection 360 and cause it to compress while the brick paver 18 is pushed downwardly into the recess or receptacle 16. The end of the brick 18 slides easily along the blade 374 of the tool 370 allowing it to be easily positioned within the recess 16. While the brick paver 18 is held in the recessed position, the blade 374 of the tool 370 is then withdrawn allowing the second projection 360 to contact the end of the brick paver 18.

The compression caused by the projections 360 against the sides of the brick pavers 18 create sufficient friction with the brick paver to adequately hold and retain the paver in proper position. Because of the bottom angled surface 364, the liner 14 and form 12 can be easily withdrawn or pulled from the construction once the concrete has set within the forms. In this way, the projections will slide easily along the end surfaces of the brick pavers 18 allowing easy removal of the forms. In this arrangement, there is no need to provide any additional labor to remove any nails or clips extending through the outer surface of the grout line. In addition, this arrangement allows the liner to be reused a number of times without having to provide any additional clips, pins or bolts to provide the same function.

Figure 36:
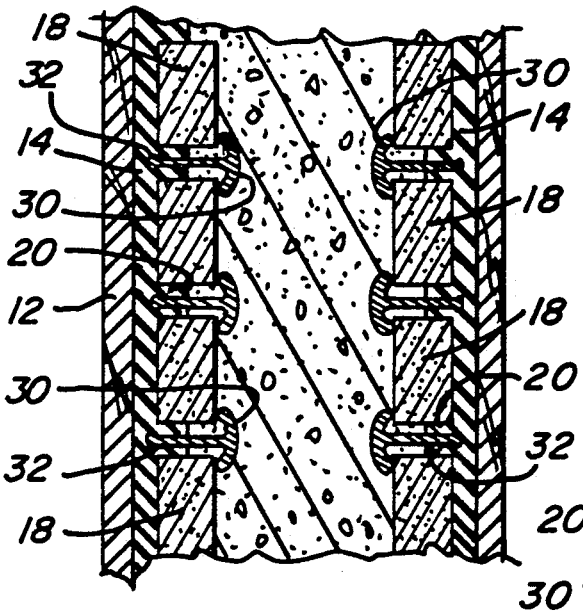
FIG. 36 is a cross-sectional view of a double-sided concrete wall showing retainers securing the bricks to the liner on both sides of the formed wall.
Figure 37:
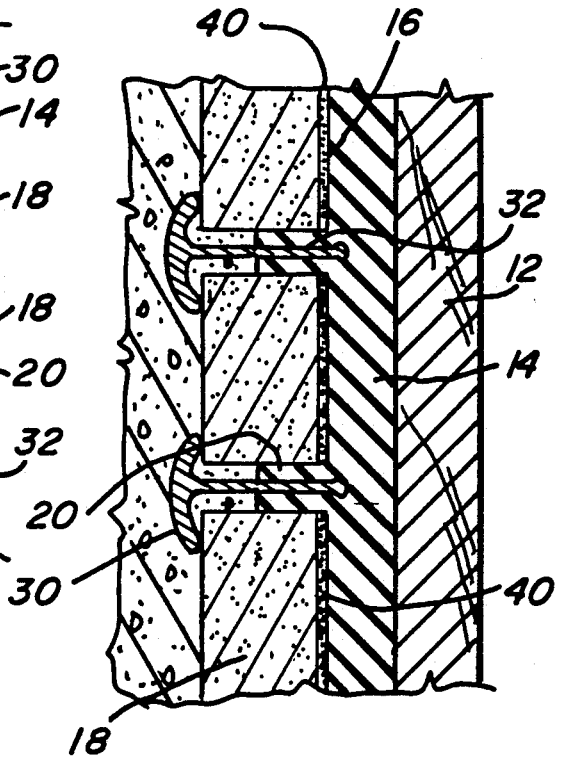
FIG. 37 is a partial cross-sectional view showing a liquid absorbent sheet lining the surface of the form recess.

FIG. 36 shows the cross section of a concrete wall form wherein a brick surface is provided on both sides of the finished wall. In this arrangement, the form **12*a*, 12*b* and form liners 14*a*, 14*b* are erected and positioned on opposite sides of the wall. The brick pavers 18 are positioned in the liner along one side of the first form 12*a* with the clips 30 inserted so as to hold the brick pavers 18 in position. Once the surface of the first form 12*a* has been completed, the second form 12*b* is erected and the brick installation is completed in the same way. The second form 12*b* is then moved into proper position and spaced with cross ties to the first form 12*a*** as previously explained. Once both forms have been completed and properly positioned, the concrete is poured between the forms forming the brick wall structure.

Figure 38:
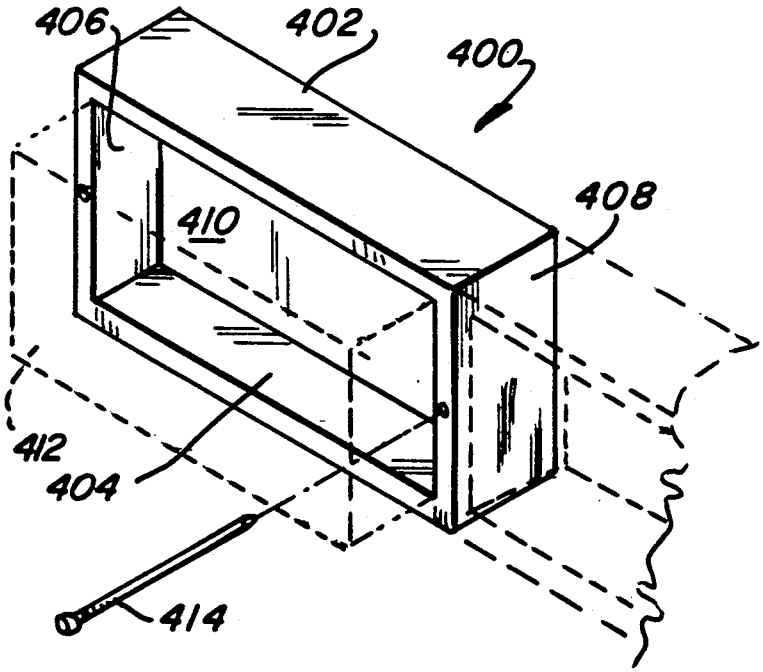
FIG. 38 is a perspective view showing a brick retainer cuff for securing the brick paver to the surface of the concrete form.
Figure 39:
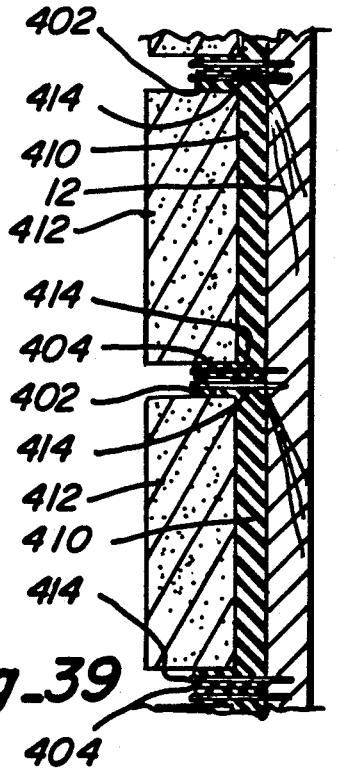
FIG. 39 is a partial cross-sectional view showing the cuff of FIG. 38 installed on the surface of the form.
Figure 40:
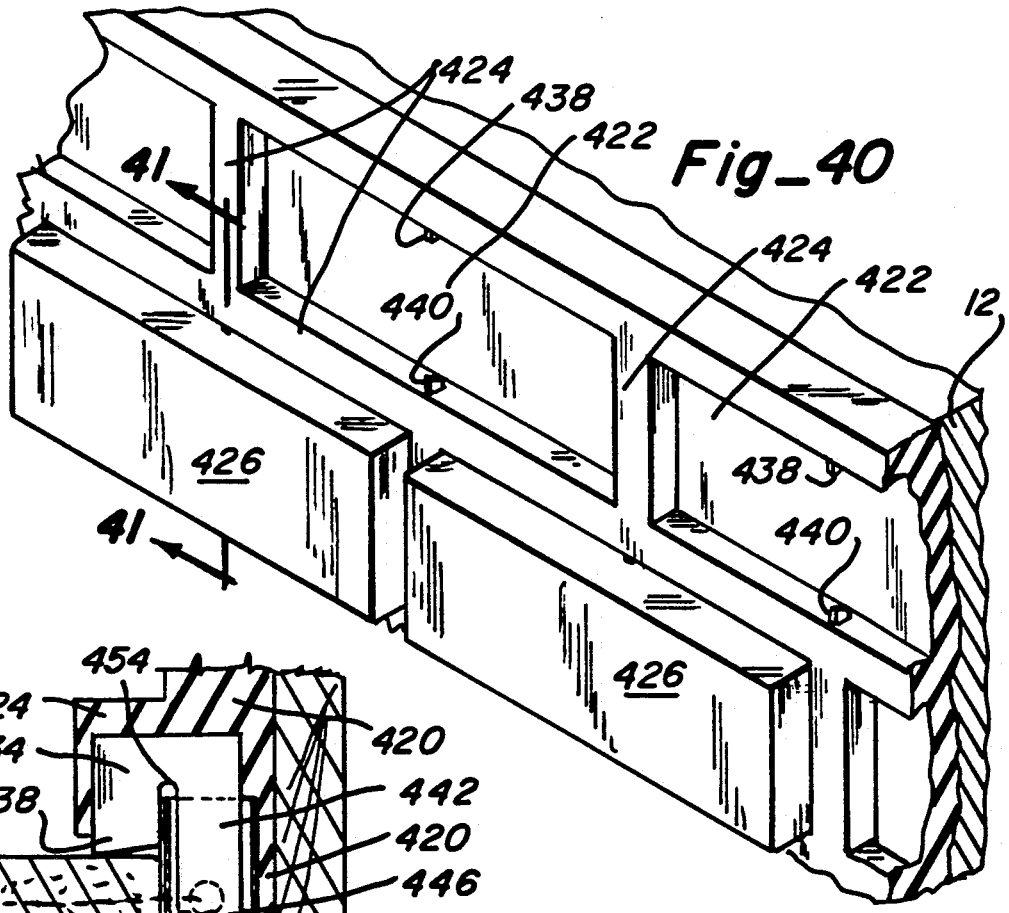
FIG. 40 is a pictorial perspective view of a clamping retainer according to the present invention positioned on each side of the recess for securely holding the brick in position.
Figure 41:
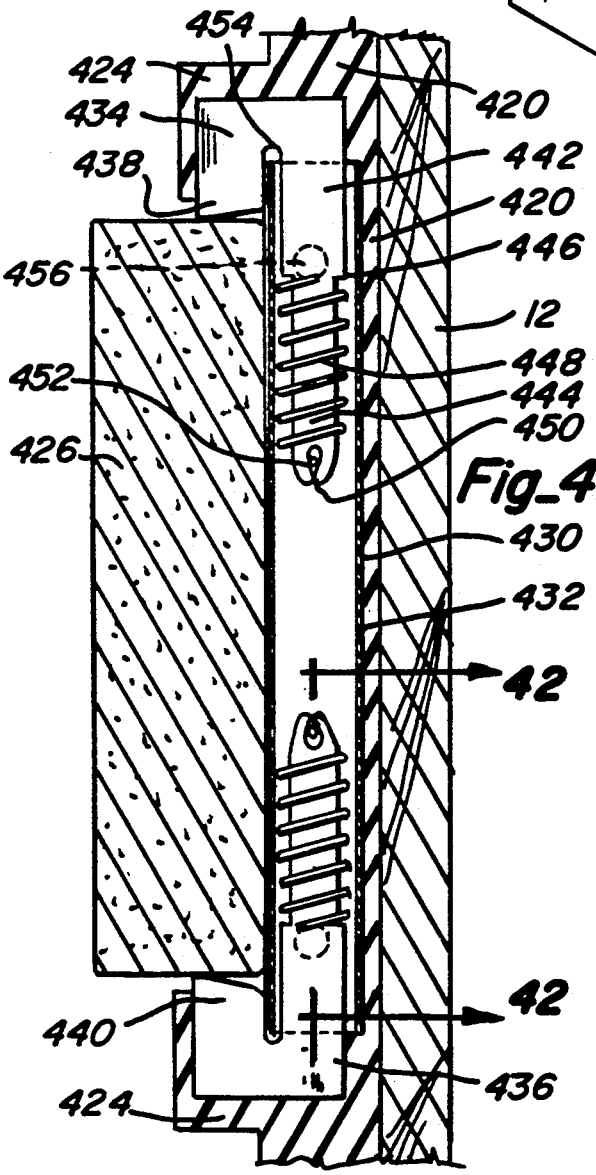
FIG. 41 is a cross-sectional view taken along lines 41—41 of FIG. 40 and showing a spring-biased clamping retainer.
Figure 42:
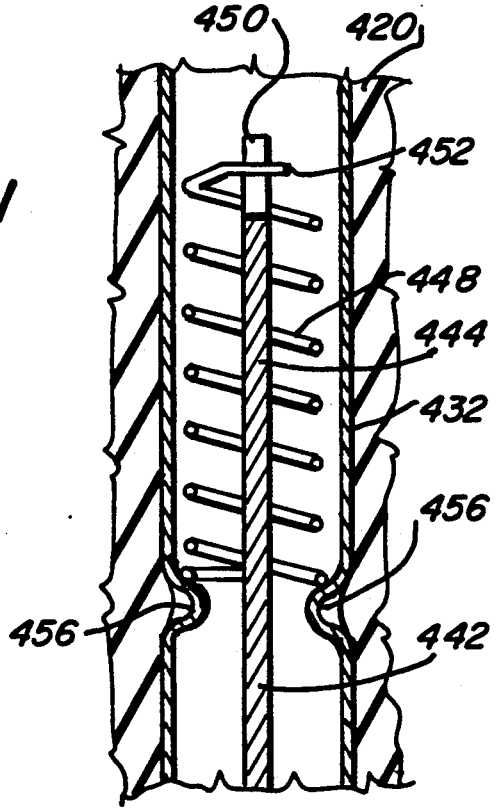
FIG. 42 is a partial cross-sectional view taken along lines 42—42 of FIG. 41.

A retainer for objects in concrete wall construction can also take other variations. For instance, according to the present invention the retainer can be in the form of an elastomeric cuff or box which is sized to receive a brick or brick paver and surround or cover the face and partially the sides of the brick. In FIG. 38, the retainer box or cuff 400 includes sides 402, 404 and ends 406, 408. If desired, a bottom surface 410 can be provided to enclose one side of the box-type retainer. The opposite side will be left open. This arrangement essentially forms a recess which can surround and support a brick or brick paver 412 which is shown in phantom lines in this illustration. The dimensions of the cuff 400 are designed to closely fit the standard outside dimensions of the face of the brick and to fit tightly around the brick to seal the edges and prevent leakage of the grout around the sides of the brick and along the face. If desired, an absorbent sheet as explained earlier can be provided along the bottom surface 410 to absorb moisture and to prevent setting of the concrete on the brick face. The thickness of the sides and edges of the retainer 400 is usually arranged to be one-half of the thickness of the normal grout separation between bricks which is desired in the finished wall. In this way, the retainer 400 can be attached to the plywood wall form 12 by suitable means such as adhesive or finishing nails 414 or any other suitable arrangement which allows the retainer 400 to be properly and securely attached to the form 12. It is naturally understood that the retainers are positioned usually in staggered arrangement to form the usual brick appearance in the finished construction. On the other hand, the retainers can be stacked vertically if a different brick pattern is desired. In this way, various designs and patterns can be formed in the final brick wall construction.

Another retainer embodiment is shown in FIGS. 4042. The basic concept includes the original concrete wall form 12 which can be plywood, metal or any other suitable material having sufficient strength and rigidity. A resilient liner 420 is also formed similar to the arrangements previously described wherein recesses 422 are formed in a staggered row pattern in the outer face of the liner 420 which forms ridges 424 of a predetermined width between the individual recesses 422. The recesses 422 are sized to generally fit a brick or brick paver 426 which can be inserted into each of the recesses 422. The liner 420 is molded from a suitable elastomeric material which will have some resilience and flexure.

A clamp-type retainer 430 is provided to support and hold the brick pavers 426 in the liner recess 422. The retainer 430 includes an elongated tubular hollow body member 432 and "J" or hook-type end pieces 434, 436. The end pieces 434, 436 can either have a flat or circular cross section which will slidably fit within the body member 432. The outer ends 436, 438, respectively, extend into the recess 422 and contact the brick paver 426 on opposite sides. It is to be understood that any number of retainers 430 can be positioned along the sides of the recess 422 to contact and retain the brick pavers 426 in proper position. By the same token, an elongated retainer 430 could be used to straddle the ends of a recess 422 and contact the ends of the brick pavers 426. In most cases, the retainers 430 will be positioned within the liner 420 at the time that it is molded. In this way, they are embedded within the material with only the end portions 438, 440 exposed within the recess 422.

While both end pieces 434, 436 are essentially identical, only one will be described. The end piece 434 includes a body 442 which is slidably inserted within the tubular member 432. The inner end 444 of the body 442 has a slightly smaller diameter which ends in a shoulder 446. A helical compression spring 448 having a proper internal diameter to slidably fit over the inner end 444 is positioned so that one end abuts against the shoulder 446. The outer portion of the end 444 has a transverse slot 450 formed at the end. The end 452 of the spring 448 is inserted within the slot 450 and the legs formed by the slot are crimped together to retain the end 452 of the spring. In this arrangement, the spring 448 is assembled and attached directly to the body 442 in a slightly compressed state.

Depending upon the width of the brick paver which is to be retained, the tubular body 432 is cut to a proper length to accept the ends 434, 436. The end of each assembly is inserted into its respective end of the tubular member 432 so that the crotch 454 of each assembly is adjacent to the ends of the tube 432. With the assembly held in position a dimple 456 is formed diametrically opposite on each side of the tube 432 to restrict the internal diameter of the tube and to contact the ends of the individual springs 448. Thus, as the outer end of each of the J-hook members is moved outward from the end of the tube, the springs 448 are caused to compress applying a bias to return the members to their original position. With the retainer 430 embedded within the liner 420, the ends 438 and 440 are exposed within the recess 422. The ends 438, 440 can be tapered so as to make a point contact against the sides of the brick. With the brick inserted into the recess, the ends 438, 440 are expanded to accept the brick and then the spring-biased tension on the ends 438, 440 grip the sides of the brick and retain it in proper position. The use of the spring biasing to hold the bricks in place allows for absorption of the vibrations which are present during the pouring of the concrete. This arrangement has been found to be quite adequate and allows the form 12 and liner 420 along with the retainers 430 to be reused a number of times without noticeable deterioration or wear.

Throughout this application, a number of retainer embodiments have been described and various configurations and materials have been discussed. It is to be understood that any material which has sufficient strength or resilience for the intended purpose will be acceptable. It is anticipated that the retainer clips can be formed from material such as Nylon, polyvinylchloride, polyethylene, synthetic resins, or metals such as aluminum, copper or steel. In addition, where resiliency is desired, suitable materials such as rubbers or elastomers can be utilized as necessary. The important consideration is the use of a suitable material which will provide the necessary and desired characteristics as well as be inexpensive to manufacture and to install. The labor necessary to install the various items has been considered and is believed to be held to a minimum with the embodiments and arrangements which have been described. In addition, it is also important to be able to reuse as much of the materials as possible. Naturally, this does not apply to the portion of the retainers which remain in the concrete and are considered to be expendable.

While an improved retainer for holding objects in a generally upright concrete construction form has been shown and described in detail in this application, it is to be understood that this invention is not to be limited to the exact form disclosed and changes in detail and construction of the various embodiments of the invention may be made without departing from the spirit thereof.

What is claimed is:

1. A retainer device for holding an object in a substantially upright concrete form while concrete is poured into and sets within the form, a surface of the retained object is intended to be exposed in an outer surface of the finished concrete structure, said retainer device comprising in combination:

a flexible liner having a recess sized to closely fit an object to be exposed in the outer surface of the finished concrete structure, said recess having a ridge formed around its perimeter to surround the edges of the object; and a retainer means attached to said flexible liner through said liner recess ridge to hold said object within the liner recess so that it will be properly positioned and not dislodged when the concrete is poured into the form, said retainer means being arranged to release from said object when the form is removed from the finished concrete structure.

2. A retainer device as defined in claim 1 which further includes fastening means, and said flexible liner is secured by said fastening means to the inside surface of said concrete form so that said flexible liner will be held securely against the form during the concrete pouring process.

3. A retainer device as defined in claim 1 wherein the object to be held in the flexible liner is a brick paver and the recess is rectangular.

4. A retainer device as defined in claim 1 wherein said flexible liner is formed from an elastomeric material to provide the required resilience as well as flexibility.

5. A retainer device as defined in claim 1 wherein the concrete form is a veneer sheet and the retainer means is attached both to the flexible liner as well as the form.

6. A retainer device for holding an object on an inside surface of a substantially upright concrete form while wet concrete is poured into and sets within the form, a surface of the retained object is intended to be exposed in an outer surface of the finished concrete structure, said retainer device comprising in combination:

(a) a flexible form liner having a recess sized to closely fit the object to be exposed in the outer surface of the finished concrete structure;

(b) a retainer means attached to said flexible liner to hold said object within the liner recess so that it will be properly positioned and not dislodged when the concrete is poured into the form; and (c) said retainer means has a central body portion and spring biased gripping means provided at each end of the body portion, the central body portion is embedded in the form liner under the liner recess whereby the gripping means will be exposed on opposite sides of the recess to apply retaining force against the sides of the object so as to hold it in proper position within said recess during the pouring and setting of the concrete.

7. A retainer device for holding a plurality of objects on an inside surface of a substantially upright concrete form while wet concrete is poured into and sets within the form, a surface of each of the retained objects is intended to be exposed in an outer surface of the finished concrete structure, said retainer device comprising:

(a) a flexible liner having a plurality of recesses each sized to fit one of the objects, each of said recesses having a ridge formed around its perimeter to surround the edges of the respective object; and (b) a plurality of retainer means each attached to said form liner through the ridge of a recess so as to retain and hold the respective object so that the said object will be held in position and not dislodged when the concrete is poured into the form, said retainer means being capable of releasing from the object when the form is removed.

8. A retainer device as defined in claim 7 wherein the recesses in said flexible liner are formed in rows and staggered so as to give the appearance of a brick wall, and the objects which are held in position by the retaining means are bricks.

9. A retainer device for holding bricks against an inside surface of a generally upright concrete form, the retainer device comprising:

(a) a flexible form liner having a plurality of staggered recesses each sized to closely fit a brick so that a plurality of bricks can be held in position during the pouring of concrete into the form to provide the appearance of a masonry brick wall in the surface of the finished concrete structure, (b) a ridge is formed around the perimeter of each of said recesses, and (c) a retaining means is provided to retain a brick within each respective recess to prevent the brick from being dislodged during the pouring and setting of the concrete, said retaining means is secured to the liner through the ridge of the recess so as to hold the brick in proper position, and the retainer means is capable of releasing from the brick when the form is removed.

10. A retainer device as defined in claim 9 wherein the retainer means includes an aperture formed in the outer surface of said resilient ridge and a plug having an enlarged end which is inserted into said aperture, said enlarged end of the plug having a diameter which is greater than the diameter of the aperture so that the ridge material between the bricks will be compressed sufficiently to contact and hold the bricks in proper position.

11. A retainer device as defined in claim 10 wherein the diameter of the end of the plug is at least 50 percent greater than the diameter of the aperture.

12. A retainer device as defined in claim 10 wherein the end of the plug has a spherical configuration.

13. A retainer device for holding bricks against an inside surface of a generally upright concrete form, the retainer device comprising:

(a) a form liner having a plurality of staggered recesses each sized to closely fit brick face so that a plurality of bricks will be held in position during the pouring of the concrete to provide the appearance of a masonry brick wall in the surface of a finished concrete structure, means provided to retain the bricks within the individual recesses so as to prevent the bricks from being dislodged during the pouring and setting of the concrete, said retaining means being arranged to securely attach to the form liner to hold the bricks in secure position and substantially release the bricks from the form liner when the liner and concrete form are removed from the surface of the structure; and (b) each of the retainer means has a central body portion and gripping means provided at each end of the body portion, the central body portion is embedded in the form liner under the liner recess whereby the gripping means will be exposed in opposite sides of the recess to apply a retaining force against the sides of the brick so as to hold it in proper position within said recess during the pouring and setting of the concrete.

14. A retainer device as defined in claim 13 wherein the body portion of said retaining means has a cylindrical housing and each of the gripping means has hooked ends and a spring-biasing means arranged to provide a tension force against the hooked ends so that a suitable retaining force is applied to each of the bricks.

15. A retainer device as defined in claim 14 wherein the gripping means are individual assemblies which are inserted into the opposite ends of said central body portion and are suitably fastened to retain the gripping means in the said body portion.

* * * * *